US010011120B2

(12) United States Patent
Will et al.

(10) Patent No.: US 10,011,120 B2
(45) **Date of Patent: *Jul. 3, 2018**

(54) SINGLE HEATING PLATEN DOUBLE-SIDED SUBLIMATION PRINTING PROCESS AND APPARATUS

(71) Applicant: The Hillman Group, Inc., Cincinnati, OH (US)

(72) Inventors: Gary Edward Will, Gold Canyon, AZ (US); Mark Leslie Tarter, Mesa, AZ (US); Bryan Keith Solace, Chandler, AZ (US); James Francis Huss, Scottsdale, AZ (US)

(73) Assignee: The Hillman Group, Inc., Cincinnati, OH (US)

( * ) Notice: Subject to any disclaimer, the term of this patent is extended or adjusted under 35 U.S.C. 154(b) by 201 days.

This patent is subject to a terminal disclaimer.

(21) Appl. No.: 13/951,150

(22) Filed: Jul. 25, 2013

(65) Prior Publication Data

US 2015/0029288 A1 Jan. 29, 2015

(51) Int. Cl.
*B30B 15/34* (2006.01)
*B41J 2/335* (2006.01)
(Continued)

(52) U.S. Cl.
CPC ..... *B41J 2/335* (2013.01); *B41F 16/006* (2013.01); *B41F 16/008* (2013.01);
(Continued)

(58) Field of Classification Search
None
See application file for complete search history.

(56) References Cited

U.S. PATENT DOCUMENTS 4,059,471 A 11/1977 Haigh
4,174,250 A 11/1979 Durand
(Continued)

FOREIGN PATENT DOCUMENTS

DE 10 1011 012833 A1 9/2012
EP 2000303 10/2008
(Continued)

OTHER PUBLICATIONS

Mug Sublimation, YouTube, http://www.youtube.com/watch?v=Xi_DB3TVAws, uploaded Jan. 21, 2008.
(Continued)

*Primary Examiner* — Alejandro Valencia
(74) *Attorney, Agent, or Firm* — Finnegan, Henderson, Farabow, Garrett & Dunner, LLP

(57) ABSTRACT

A process and apparatus for sublimating printed images onto two or more sides of a product simultaneously using a single heating platen are disclosed. The apparatus is configured to print one or more images onto transfer media, then position the transfer media onto a substrate. A product to receive the sublimated image is positioned on top of the transfer media, and the apparatus manipulates the transfer media to substantially surround the product and place at least one image onto each side of the product to be sublimated. A single heating platen then engages the transfer media to sublimate the image. The heating platen is configured, using a control, to sublimate opposing sides of a product substantially simultaneously in a single thermal cycle.

4 Claims, 14 Drawing Sheets

(51) Int. Cl.

| | |
|---|---|
| ***B41M 5/382*** | (2006.01) |
| ***B41F 16/00*** | (2006.01) |
| ***B44C 1/17*** | (2006.01) |
| ***B41M 5/035*** | (2006.01) |

(52) U.S. Cl.

CPC ..... *B41F 16/0046* (2013.01); *B41M 5/0358* (2013.01); *B41M 5/382* (2013.01); *B44C 1/1712* (2013.01)

(56) References Cited

U.S. PATENT DOCUMENTS 4,202,663 A 5/1980 Haigh et al.
4,242,092 A 12/1980 Glover
4,253,838 A 3/1981 Mizuno et al.
4,314,814 A 2/1982 Deroode
4,465,728 A 8/1984 Haigh et al.
4,662,966 A 5/1987 Sumi et al.
4,664,672 A 5/1987 Krajec et al.
4,670,084 A 6/1987 Durand
4,933,315 A 6/1990 Kanto et al.
4,943,555 A 7/1990 Nakamoto et al.
4,990,485 A 2/1991 Egashira et al.
5,122,499 A 6/1992 Janssens et al.
5,135,905 A 8/1992 Egashira et al.
5,202,176 A 4/1993 Higuchi et al.
5,244,234 A 9/1993 Oshima et al.
5,246,518 A 9/1993 Hale
5,248,363 A 9/1993 Hale
5,252,530 A 10/1993 Nakamura
5,254,523 A 10/1993 Fujimura et al.
5,302,223 A 4/1994 Hale
5,308,426 A 5/1994 Claveau
5,344,807 A 9/1994 Nakamura
5,346,877 A 9/1994 Nakamura
5,354,401 A 10/1994 Asahi et al.
5,431,501 A 7/1995 Hale et al.
5,432,145 A 7/1995 Oshima et al.
5,468,714 A 11/1995 Oshima et al.
5,487,614 A 1/1996 Hale
5,488,907 A 2/1996 Xu et al.
5,522,317 A 6/1996 Hale et al.
5,546,316 A 8/1996 Buckley et al.
5,550,098 A 8/1996 Aso et al.
5,555,813 A 9/1996 Hale et al.
5,574,829 A 11/1996 Wallace et al.
5,575,877 A 11/1996 Hale et al.
5,580,410 A 12/1996 Johnston
5,590,600 A 1/1997 Hale et al.
5,601,023 A 2/1997 Hale et al.
5,623,581 A 4/1997 Attenberg
5,630,894 A 5/1997 Koch et al.
5,634,731 A 6/1997 Kita et al.
5,640,180 A 6/1997 Hale et al.
5,642,141 A 6/1997 Hale et al.
5,643,387 A 7/1997 Berghauser et al.
5,644,988 A 7/1997 Xu et al.
5,734,396 A 3/1998 Hale et al.
5,830,263 A 11/1998 Hale et al.
5,959,278 A 9/1999 Kobayashi et al.
5,962,368 A 10/1999 Poole
5,997,677 A 12/1999 Zaher
6,103,041 A 8/2000 Wagner et al.
6,105,502 A 8/2000 Wagner et al.
6,110,316 A 8/2000 Kobayashi et al.
6,118,545 A 9/2000 Kawai et al.
6,149,754 A 11/2000 Ogata et al.
6,165,938 A 12/2000 Narita et al.
6,186,207 B1 * 2/2001 Berghauser ..... B41M 5/035 156/384
6,249,297 B1 6/2001 Lion
6,298,685 B1 * 10/2001 Tepman ..... C23C 14/568 62/378
6,341,856 B1 1/2002 Thompson et al.
6,344,103 B1 2/2002 Cheng et al.
6,348,939 B1 2/2002 Xu et al.
6,392,680 B2 5/2002 Akada et al.
6,402,313 B1 6/2002 Xu et al.
6,425,331 B1 7/2002 Xu et al.
6,439,710 B1 8/2002 Hale et al.
6,447,629 B1 9/2002 Thompson et al.
6,450,098 B1 9/2002 Hale et al.
6,474,230 B2 11/2002 Corrado
6,486,903 B1 11/2002 Wagner et al.
6,488,370 B2 12/2002 Hale et al.
6,535,791 B1 3/2003 Wang
6,540,345 B1 4/2003 Wagner et al.
6,618,066 B2 9/2003 Hale et al.
6,623,677 B1 9/2003 Smith et al.
6,631,984 B2 10/2003 Thompson et al.
RE38,295 E 11/2003 Kobayashi et al.
6,649,317 B2 11/2003 Wagner et al.
6,673,503 B2 1/2004 Wagner et al.
6,681,151 B1 1/2004 Weinzimmer et al.
6,686,314 B2 2/2004 Xu et al.
6,814,831 B2 11/2004 Drake
6,816,752 B1 11/2004 Wang
6,840,614 B2 1/2005 Wagner et al.
6,849,370 B2 2/2005 Wagner et al.
6,887,640 B2 5/2005 Zhang et al.
6,961,076 B2 11/2005 Wagner et al.
6,966,643 B2 11/2005 Hale et al.
RE38,952 E 1/2006 Hale et al.
6,998,005 B2 2/2006 Magee et al.
7,001,649 B2 2/2006 Wagner et al.
7,041,424 B2 5/2006 Xu et al.
7,137,426 B2 11/2006 Neri et al.
7,154,630 B1 12/2006 Nimura et al.
7,156,566 B2 1/2007 Johnson et al.
7,166,191 B2 1/2007 Suzuki et al.
7,212,308 B2 5/2007 Morgan
7,267,737 B2 9/2007 Neri et al.
7,524,048 B2 4/2009 Xu
7,527,655 B1 5/2009 Wagner et al.
7,563,341 B2 7/2009 Ferguson et al.
7,654,660 B2 2/2010 Hale et al.
7,810,538 B2 10/2010 Magee et al.
7,870,824 B2 1/2011 Helma et al.
8,029,883 B2 10/2011 Xu et al.
8,268,546 B2 9/2012 Kobayashi et al.
8,283,290 B2 10/2012 Langan et al.
8,308,891 B2 11/2012 Drake et al.
8,337,006 B2 12/2012 Hale et al.
8,343,574 B2 1/2013 Downs et al.
8,349,114 B2 1/2013 Green
8,387,673 B2 3/2013 Spengler
8,398,224 B2 3/2013 Hale et al.
8,400,485 B2 3/2013 Hirota
8,405,694 B2 3/2013 Hsu et al.
8,425,029 B2 4/2013 Xu
8,731,703 B1 5/2014 Lehrer et al.
9,333,788 B2 5/2016 Will et al.
9,403,394 B2 * 8/2016 Rosner ..... B41F 16/0046
9,446,599 B2 9/2016 Will et al.
9,731,534 B2 8/2017 Will et al.
2002/0066378 A1 6/2002 Almblad et al.
2002/0103034 A1 8/2002 Kammerer et al.
2002/0126132 A1 9/2002 Karatassos et al.
2002/0186290 A1 12/2002 Ogasawara
2004/0050279 A1 3/2004 Ibarra et al.
2004/0143914 A1 7/2004 Flaherty
2004/0170415 A1 9/2004 Maeda et al.
2005/0070434 A1 3/2005 Drake
2005/0150591 A1 * 7/2005 Goertzen ..... B44C 1/1716 156/230
2005/0212843 A1 9/2005 Jones et al.
2005/0248649 A1 11/2005 Farrell et al.
2005/0275870 A1 12/2005 Elarde et al.
2006/0159851 A1 7/2006 Tomasella et al.
2007/0181253 A1 8/2007 Xu et al.
2007/0213216 A1 * 9/2007 Lindemann et al. ..... 503/227
2008/0095940 A1 4/2008 Lee et al.
2008/0213027 A1 9/2008 Yraceburu et al.
2010/0007896 A1 1/2010 Fishbaine

(56) References Cited

U.S. PATENT DOCUMENTS

| | | | |
|---|---|---|---|
| 2010/0129621 | A1 | 5/2010 | Langan et al. |
| 2010/0266817 | A1 | 10/2010 | Hirst |
| 2011/0111188 | A1 | 5/2011 | Xu et al. |
| 2011/0180202 | A1 | 7/2011 | Hirst et al. |
| 2012/0001978 | A1 | 1/2012 | Burke |
| 2012/0044312 | A1 | 2/2012 | Hirst |
| 2012/0219652 | A1 | 8/2012 | Simons |
| 2012/0225518 | A1 | 9/2012 | De Santi et al. |
| 2012/0297041 | A1 | 11/2012 | Momchilov |
| 2012/0301122 | A1 | 11/2012 | Chao et al. |
| 2012/0320136 | A1 | 12/2012 | Xu |
| 2012/0327257 | A1 | 12/2012 | O'Keefe et al. |
| 2013/0045341 | A1 | 2/2013 | Ramsden |
| 2015/0028094 | A1 | 1/2015 | Will et al. |
| 2015/0029285 | A1 | 1/2015 | Will et al. |
| 2015/0029288 | A1 | 1/2015 | Will et al. |
| 2015/0029289 | A1 | 1/2015 | Rosner et al. |
| 2015/0032528 | A1 | 1/2015 | Will et al. |
| 2016/0221354 | A1 | 8/2016 | Will et al. |

FOREIGN PATENT DOCUMENTS

| | | | |
|---|---|---|---|
| GB | 2 130 144 | A | 5/1984 |
| WO | WO 96/006729 | A1 | 3/1996 |
| WO | WO 97/009180 | A1 | 3/1997 |
| WO | WO 00/007822 | A1 | 2/2000 |
| WO | WO 2005/0105470 | | 11/2005 |
| WO | WO 2008/0144839 | | 12/2008 |
| WO | WO 2009/053721 | A1 | 4/2009 |
| WO | WO 2011/0003125 | | 1/2011 |
| WO | WO 2011/0039785 | | 4/2011 |
| WO | WO 2012/141985 | A1 | 10/2012 |

OTHER PUBLICATIONS

European Patent Office, International Search Report for PCT Application No. PCT/US2014/047396, dated Dec. 16, 2014, 6 pages.

European Patent Office, Written Opinion of the International Searching Authority for PCT Application No. PCT/US2014/047396, dated Dec. 16, 2014, 7 pages.

European Patent Office, International Search Report for PCT Application No. PCT/US2014/046944, dated Dec. 15, 2014, 6 pages.

European Patent Office, Written Opinion of the International Searching Authority for PCT Application No. PCT/US2014/046944, dated Dec. 15, 2014, 9 pages.

European Patent Office, International Search Report for PCT Application No. PCT/US2014/047527, dated Feb. 12, 2015, 3 pages.

European Patent Office, Written Opinion of the International Searching Authority for PCT Application No. PCT/US2014/047527, dated Feb. 12, 2015, 7 pages.

European Patent Office, International Search Report for PCT Application No. PCT/US2014/045719, dated Feb. 13, 2015, 3 pages.

European Patent Office, Written Opinion of the International Searching Authority for PCT Application No. PCT/US2014/045719, dated Feb. 13, 2015, 9 pages.

European Patent Office, International Search Report for PCT Application No. PCT/US2014/047142, dated Feb. 19, 2015, 3 pages.

European Patent Office, Written Opinion of the International Searching Authority for PCT Application No. PCT/US2014/047142, dated Feb. 19, 2015, 9 pages.

Office Action, U.S. Appl. No. 13/951,127, dated Mar. 17, 2015, 7 pages.

* cited by examiner

800

SINGLE HEATING PLATEN DOUBLE-SIDED SUBLIMATION PRINTING PROCESS AND APPARATUS

FIELD

The present disclosure generally relates to dye sublimation transfer printing, and more particularly, to a method and apparatus for sublimating one or more images substantially simultaneously on opposing sides of a product capable of incorporating sublimation dye.

BACKGROUND

Dye sublimation is a process employing heat and pressure to convert solid dyes into gaseous form without entering an intermediate liquid phase. Such a process can infuse colored dye into certain compatible materials, such as polyester or ceramics, to create a permanent printed image on the material.

Two primary types of dye sublimation printing systems exist in the marketplace. In a "direct" sublimation system, the printing system is configured to sublimate an image directly onto a compatible surface. Alternatively, in "transfer" systems, the images to be sublimated are first printed on an intermediate media, such as a coated paper or ribbon, and then transferred to a compatible surface using heat and pressure. In a traditional system, images are transferred onto only one opposing side of a product at a time, or utilize multiple heating platens.

Expediting and streamlining the printing and sublimation process would increase efficiency and profitability. One possible means of speeding up sublimation printing would be to configure the system to simultaneously print on multiple surfaces of a three-dimensional product. Optimization in this manner not only reduces the time of the process but is safer (since flipping the product for printing on the other side is not required) and reduces material waste. In a retail environment, simultaneous double-sided printing may increase the revenue-generating capability of a sublimation machine, since a greater number of products can be produced in a given amount of time. Accuracy and quality of the sublimated products is also improved, since the printed images and the products to be sublimated need only be aligned one time. Double-sided printing also facilitates greater automation of the sublimation process, as the entire sublimation printing task can be performed without the input of a trained operator.

One attempt at a dye sublimation printer system capable of printing on multiple surfaces of a product is described in U.S. Pat. No. 7,563,341 (the '341 patent) issued to Ferguson, et al. on Jul. 21, 2009. In particular, the '341 patent discloses a dye transfer sublimation system in which a three-dimensional object for sublimation is placed on a structural base topped with a molded, heat-resistant surface such as silicone rubber. An image carrier sheet pre-printed with dye images is placed onto the product, and a "flexible membrane" is then lowered onto the sheet and secured with vacuum pressure. Flexible heating elements, such as an electrical circuit etched in a metal foil, are integrated into either the image carrier sheet or the flexible membrane. The system is heated in a manner that the top and possibly the side surfaces of an object may be sublimated with the printed images.

Although the systems and methods disclosed in the '341 patent may assist an operator in sublimating onto multiple surfaces of a product, the disclosed system is limited. The '341 system does not easily lend itself to streamlined automation, as no integrated system is disclosed, and the components must be manually placed and aligned. The system components are open to the air, and thus could present a safety hazard, particularly to an untrained operator. Finally, although the top and smaller sides of a three-dimensional object can be printed using this system, there is no capability for printing onto both the top and bottom sides of an object simultaneously. The '341 system contains significant limitations that would make it unsuitable for a merchant, such as a retail outlet, seeking to add a dye sublimation system to market personalized products to consumers.

The disclosed system is directed to overcoming one or more of the problems set forth above and/or elsewhere in the prior art.

SUMMARY

The present invention is directed to an improved single heating platen, double-sided sublimation transfer printing method and apparatus. The advantages and purposes of the invention will be set forth in part in the description which follows, and in part will be apparent from the description, or may be learned by practice of the invention. The advantages and purposes of the invention will be realized and attained by the elements and combinations particularly pointed out in the appended claims.

In accordance with one aspect of the invention, a method for sublimating images on a product is disclosed. The method comprises printing one or more images identified by a customer for the product on a transfer media. The method further comprises positioning the transfer media on a substrate. Additionally, the method includes positioning at least one product onto the transfer media. The method also includes manipulating the transfer media to substantially surround the product, wherein at least one printed image is positioned onto each side of the product to be sublimated. Further, the method includes the step of configuring a single thermal cycle for a single heating platen such that the images will be sublimated substantially simultaneously onto each side of the product in a single thermal cycle. The method further comprises moving the single heating platen into contact with the transfer media. Finally, the method comprises sublimating the image from the transfer media to each side of the product using the configured single thermal cycle of the single heating platen.

In another aspect, the invention is directed to a method for sublimating images on a product in a retail environment. The method comprises printing one or more images identified by a customer for the product on a transfer media. The method further comprises positioning the transfer media on a substrate. Additionally, the method includes selecting a product from a plurality of products, each of the plurality of products comprised of a material capable of incorporating sublimation dye. The method also includes the step of retrieving the selected product, and positioning it onto the transfer media. Additionally, the method comprises manipulating the transfer media to substantially surround the selected product, wherein at least one printed image is positioned onto each side of the product to be sublimated. The method includes configuring a single thermal cycle for a single heating platen such that the images will be sublimated substantially simultaneously onto each side of the product in a single thermal cycle. The method additionally includes moving the single heating platen into contact with the transfer media. Also, the method includes sublimating at least one image from the transfer media to each side of the product using the configured single thermal cycle of the single heating platen. The method further includes cooling the sublimated product to at least about an ambient temperature. Finally, the method comprises providing the cooled, sublimated product to the customer.

In yet another aspect, the invention is directed to an apparatus for sublimating an image on a product. The apparatus comprises a dye sublimation transfer printer which is configured to receive one or more digital image files representing one or more images, and further configured to print the received images on a transfer media. The apparatus further comprises a substrate configured to receive the transfer media from the printer. The apparatus includes a single heating platen configured to engage the transfer media, and a control unit for configuring a single thermal cycle for the single heating platen such that the images will be sublimated substantially simultaneously onto each side of the product in a single thermal cycle.

Additional objects and advantages of the invention will be set forth in part in the description which follows, and in part will be apparent from the description, or may be learned by practice of the embodiments. The objects and advantages of the invention will be realized and attained by the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate various embodiments and aspects of the disclosed embodiments and, together with the description, serve to explain the principles of the disclosed embodiments. In the drawings.

DETAILED DESCRIPTION

Reference will now be made in detail to various embodiments, examples of which are illustrated in the accompanying drawings. Wherever possible, the same reference numbers will be used throughout the drawings to refer to the same or like parts.

Figure 1:
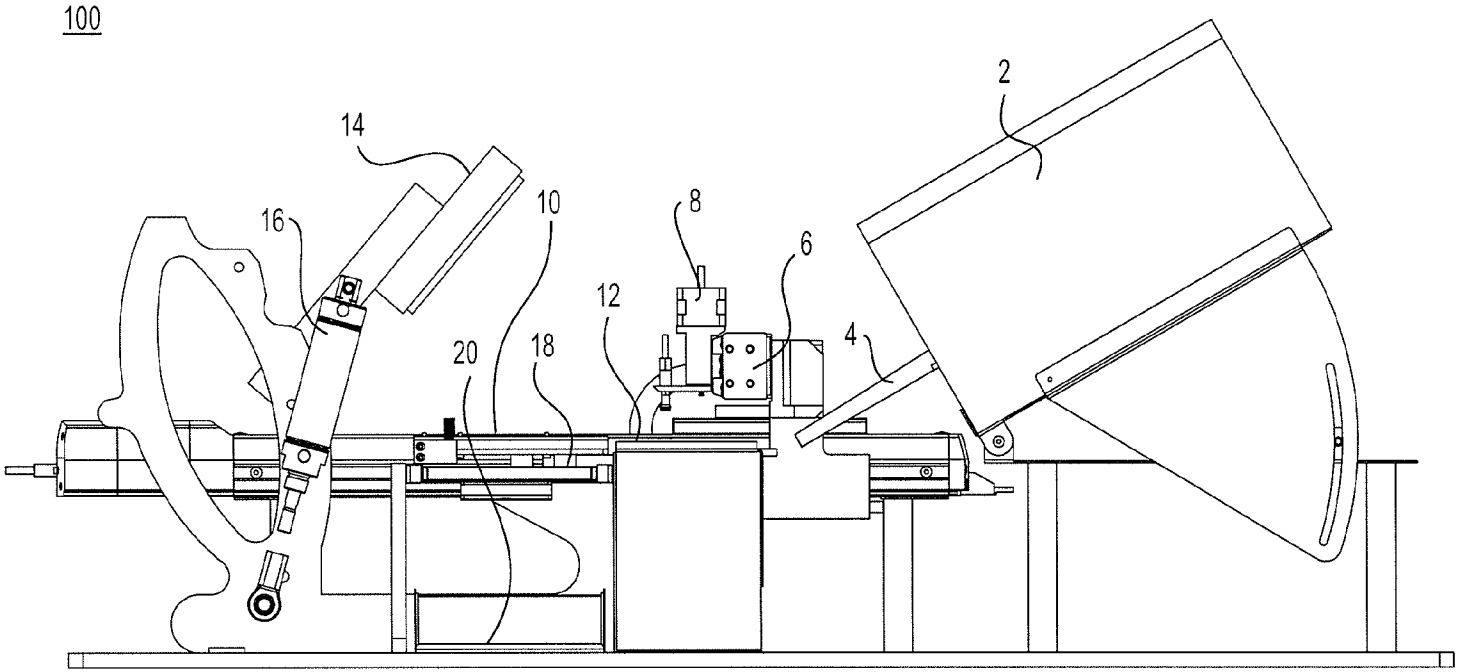
FIG. 1 is a front view of an exemplary dye sublimation transfer printing apparatus consistent with disclosed embodiments.
Figure 2:
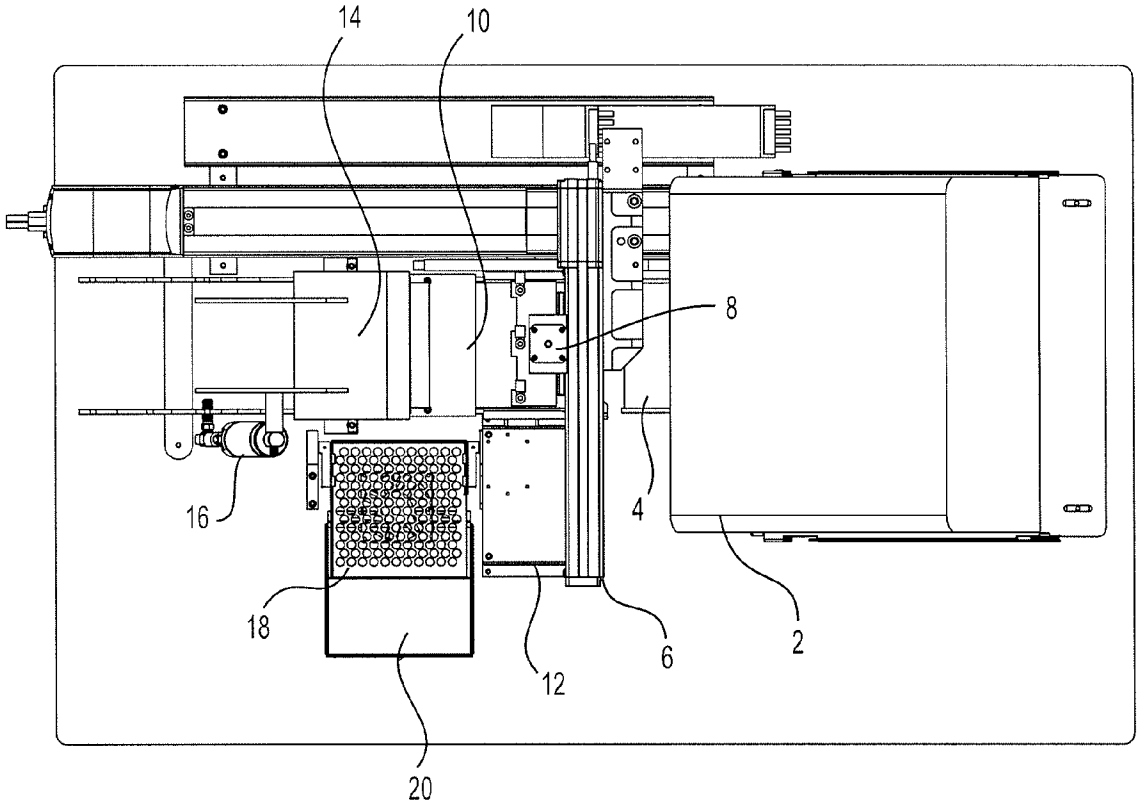
FIG. 2 is a top view of the dye sublimation transfer printing apparatus of FIG. 1.

FIGS. 1 and 2 illustrate an exemplary dye sublimation transfer printing apparatus 100. Apparatus 100 may contain various modules to complete printing and sublimation tasks. As used herein, "module" is not used in a manner requiring a completely separate modular arrangement. Rather, "module" is used more generally to refer to the components necessary to provide the required functionality. In effect, the noted modules are subsystems within the integrated apparatus. Depending upon the applications and requirements of a given customer, the integrated apparatus can be customized to include only the desired subsystems. As such, FIG. 1 is but one example of an apparatus within the scope of the invention.

Apparatus 100 may be configured in a variety of ways depending on the needs and applications of the user. In some embodiments, apparatus 100 may be configured as a full kiosk, in which most if not all components of the apparatus are fully enclosed. In such embodiments, all components may be fully automated and an untrained user may be capable of operating the entire apparatus. An added advantage is that the untrained user faces no risk of injury from heat, clamping, pinching, or moving parts since the kiosk is fully enclosed.

In other embodiments, apparatus 100 may be configured as a clerk-operated kiosk with an offboard inventory of products to be sublimated. In this configuration, a subset of the automated modules discussed above may be substituted with manual variations operable by an operator such as a clerk or employee of a retail establishment. A clerk-operated kiosk may be situated in a retail establishment in a location accessible to employees of the establishment, such as behind a counter or in a restricted area. In the clerk-operated kiosk configuration, apparatus 100 may or may not have all components enclosed.

In still other embodiments, apparatus 100 may be configured as a customer-operated kiosk with an offboard inventory of products to be sublimated. In this configuration, a subset of the automated modules discussed above may be substituted with manual variations operable by an untrained operator such as a customer of a retail establishment. A customer-operated kiosk with an offboard inventory of products to be sublimated may be situated in a retail establishment in a location potentially accessible both to customers of the establishment and to employees of the establishment. In the customer-operated kiosk configuration, apparatus 100 may or may not have all components enclosed. The non-enclosed components may not be fully accessible to the customer. In some embodiments, apparatus 100 may be configured as a hybrid kiosk with offboard inventory, with some modules configured to be operable by a clerk, and some configured to be operable by a customer.

Apparatus 100 includes a printer 2 for printing images onto transfer media. Printer 2 may be electronically configured to receive a digital image file from an operator or a customer. The digital image file may represent images such as pictures, text, stylized text, or a combination of these elements. In some embodiments, printer 2 may receive the digital image file directly, and may include digital media input interface components. In other embodiments, printer 2 may be linked via a physical or a network connection to a distinct interface device or module (not shown) which is configured to receive the digital image file and/or permit a user to determine a digital image file for printing. Apparatus 100 and printer 2 may be configured to receive a digital image file from a user in various ways, including but not limited to receiving insertion of flash memory or a USB drive, connecting via a USB or Firewire® cable, receiving image files by email, receiving image files uploaded via a mobile application, retrieving user-submitted image files from an online library or website, etc. In some embodiments, apparatus 100 may include a scanner, which can receive a physical image from a user, convert it into a digital image file, and provide it to printer 2. The scanner may be further configured to enhance or alter the acquired digital image file before providing it to printer 2. Examples of image file enhancements may include, but are not limited to, changing the size of the image, rotating, reversing, or translating the image, altering color brightness, reducing blur, de-skewing, cropping, etc.

In other embodiments, printer 2 may be configured to receive a digital image file selected at the point of sale by a user from a library or database containing a plurality of preloaded stock image files. In still other embodiments, printer 2 may be configured to receive digital image file taken by a camera, which may be (but need not necessarily be) associated with apparatus 100. In yet other embodiments, apparatus 100 may be capable of receiving input in the form of text from a user, and may convert or incorporate the text into a printable digital image file for sublimation. Printer 2 may be configured to utilize standard sublimation dyes known in the art to print the received digital image file onto suitable transfer media. The transfer media may comprise any material capable of receiving a printed dye image, including but not limited to coated or uncoated paper, card stock, film, resin, wax, ribbon, tape, etc.

In the illustration shown in FIGS. 1 and 2, printer 2 is configured to print images onto individual sheets of transfer media. In some embodiments, printer 2 may include or be connected to a bulk storage unit containing a plurality of sheets of transfer media. In other embodiments, individual sheets of the transfer media may be fed into printer 2 one sheet at a time. Printer 2 may be configured to automatically feed the sheets of transfer media into proximity with the print head and sublimation dyes for printing. Alternatively, printer 2 may be configured as a manual, hand-fed printer in which an operator may introduce each sheet of transfer media into the printer. Some embodiments of printer 2 may be capable of both manual and automatic sheet feeding. In alternative embodiments, the transfer media may be provided on continuous rolls of media rather than individual sheets, which will be described in further detail in association with FIGS. 3 and 4.

Printer 2 may be configured to print a dye image on one side of each sheet of the transfer media, or alternatively may be capable of printing dye images on both sides of each sheet. Printer 2 may be configured to print the images in a single pass, or may require two passes, such as for complex images, multiple colors, or multiple layers of images. For example, a printed dye image may include multiple distinct images superimposed into a single image. Printer 2 may print the superimposed image in a single pass, or may print each constituent image in its own pass through the machine.

In some embodiments, the sheets of transfer media supplied to printer 2 may be configured to facilitate transfer of a printed image onto multiple surfaces of a product. The sheets of transfer media may contain pre-treatments or features that bisect the sheets and enhance the reliability and repeatability of folding. In some embodiments, the sheets may be pre-creased. In other embodiments, the sheets may be pre-scored. In yet other embodiments, the sheets may be perforated. In alternative embodiments, the bisecting feature may comprise a line pre-printed onto the transfer media that is configured to align with other components of the apparatus, such as a mechanical element associated with end effector 8 or a fold bar (not shown). System 100 may employ mechanical or optical non-contact sensing elements to assist with alignment of the pre-printed line. In these embodiments, printer 2 may print one or more images on either side of the bisecting feature of the sheet to correspond to images that will be sublimated onto various surfaces of a product. The pre-creasing, pre-scoring, pre-printing of a line, and/or perforation of the sheets readily enables proper alignment of the printed images with respect to each other, with respect to system 100, and with respect to the products to be sublimated. In some embodiments, the bisecting feature may serve as a positional register for the apparatus, since its location is predictable on the sheets of transfer media. The pre-creasing, pre-scoring, pre-printing of a line, and/or perforation of the sheets of transfer media further facilitates sublimation of images onto opposing sides of a product. System 100 may include components that are configured to manipulate the transfer media at the bisecting feature (e.g. crease, score, line, or perforation), in a manner that substantially surrounds both sides of a product. In such embodiments, both sides can be sublimated substantially simultaneously with increased efficiency and reduced time, wear on the machine, and waste.

Printer 2 may provide printed sheets of transfer media to other components of apparatus 100 in various ways. In the illustrated embodiment shown in FIGS. 1 and 2, printer 2 is disposed at an angle such that gravity assists the providing of the printed sheets. When printing is complete, the sheet may naturally fall onto transfer media tray 4 and interact with other components of apparatus 100. In other embodiments, components may assist the printed sheets of transfer media to interact with other components. For example, printer 2 and transfer media tray 4 may interface with a feed line comprising a series of guides and rollers that may lead the sheet to the next component of the apparatus. In alternative embodiments, particularly clerk-operated kiosk embodiments with offboard inventory, apparatus 100 may be configured to simply allow an operator to place and transport the printed transfer media by hand to other parts of the system. In these embodiments, printer 2 may be disposed in a manner such that it is separate from the rest of the components of apparatus 100 and not enclosed in any kiosk or housing associated with the apparatus. For example, printer 2 and tray 4 may not be physically connected to one another. In these embodiments, an operator may feed the sheet or sheets of transfer media into printer 2 for printing, and then manually place the transfer media, now containing the printed images, onto tray 4 for introduction into the other components of apparatus 100. In still other embodiments, apparatus 100 may include an active transport mechanism, such as transport mechanism 6, to assist with positioning of the transfer media. In still other embodiments, a user may place the transfer media with a printed image directly onto a substrate within the housing, such as substrate 10.

Transport mechanism 6 may be any type of robot configured to transfer elements through apparatus 100. In the illustrated example of FIGS. 1 and 2, transport mechanism 6 is configured as a linear robotic unit disposed on rails, with a control head capable of coordinating linear movement in three dimensions. In other embodiments, transport mechanism 6 may be a true mechanical arm capable of free range motion in all directions. Transport mechanism 6 may include a stepper motor, a piezoelectric motor, or any other system of mechanized propulsion. In some embodiments, transport mechanism 6 may be battery-powered and be independent from any electrical system associated with apparatus 100.

Transport mechanism 6 (including end effector 8) may be configured to interface with the transfer media and/or products for sublimation. End effector 8 may include members that allow it to physically grasp items, such as pillars, pegs, or claws. End effector 8 may include magnets that allow it to transport and manipulate magnetic metallic items via electromagnetic force. In other embodiments, end effector 8 may be connected to a vacuum system and may be configured to pick up and transport items via suction. In some embodiments, end effector 8 may be configured to pick up and transport items via the mechanical grasping members described above. In some embodiments, transport mechanism 6 may contain multiple end effectors 8.

Transport mechanism 6 and end effector 8 may thus be configured to transport printed sheets of transfer media to other parts of apparatus 100. In some embodiments, mechanism 6 moves the transfer media directly from tray 4 to substrate 10. As discussed above, the printed transfer media may access tray 4 directly from printer 2, and may automatically be fed onto the tray. In other embodiments, the printed transfer media may be placed directly on tray 4 by an operator or by transport mechanism 6. Substrate 10 is a flat platen configured to receive the transfer media and align and register it to prepare for the sublimation process. In some embodiments, substrate 10 may be a bare platen comprised of metal, plastic, or composite product. In preferred embodiments, substrate 10 may be coated or covered with a non-conductive material, such as a thermal neoprene, to prevent unwanted heat transfer and reflection during the sublimation process. In alternative embodiments, substrate 10 may be configured to provide heat to the sublimation process.

Substrate 10 may include components that assist in positioning and securing the transfer media to ensure faithful transfer of the printed image to a desired product. In some embodiments, particularly the clerk-operated kiosk embodiments discussed above, an operator may place the printed transfer media directly onto substrate 10, and transport mechanism 6 may assist only in registration and alignment of the printed transfer media. In some embodiments, substrate 10 may be disposed above a vacuum system (not shown) which provides light suction to secure a portion of the printed transfer media onto substrate 10. In other embodiments, substrate 10 may include one or more clamps disposed on top of the substrate to secure the transfer media to the substrate for sublimation.

Transport mechanism 6 and/or substrate 10 may include features, such as contact or non-contact sensors, to assist with the registration and alignment of the transfer media and/or the products that will receive the sublimated image. In some embodiments, substrate 10 may be disposed relative to tray 4 such that a series of mechanical guides assist in the placement of the transfer media. For example, tray 4 may be configured to form a funnel shape, such that the transfer media can only approach substrate 10 in a predetermined manner. Substrate 10 may be fitted with guide rails or other such stationary mechanical implements to position and align the transfer media and/or products. Such mechanical implements may be disposed under the immediate surface of substrate 10, and may be situated in holes or divots in substrate 10 and/or any non-conductive surface coating. In some embodiments, the mechanical implements may be retractable, and are only visible and engaged while aligning and positioning the transfer media.

In some embodiments, substrate 10 may include one or more mechanical switches that provide guidance for orientation and alignment of the transfer media. In some embodiments, the switches may serve as stops for the transfer media, such that when an edge of the media hits the switch, apparatus 100 automatically stops moving the media in that direction. In other embodiments, the mechanical switches may be configured to serve as gates, and may be retractable. The transfer media may be fed or transported over top of the gate switches, then positioned in the X-Y dimension once beyond the gates. Various configurations of mechanical switches are contemplated for assisting with alignment of the transfer media and/or products for sublimation, which will be described in further detail below.

Transport mechanism 6 and substrate 10 may also include one or more non-contact sensors to aid in automatic transfer media and/or product alignment, orientation, and registration. Non-contact sensors within the scope of the invention include, but are not limited to, optical sensors, proximity sensors, or digital cameras, which may be mounted on any or all of transport mechanism 6, end effector 8, and substrate 10. For example, substrate 10 may include light sources configured to provide through beams of visible, infrared, or laser light that may indicate to an operator if the transfer media is properly aligned and registered on substrate 10. The indication may occur visually on substrate 10 or a nearby structure itself (for example, red and green LED lights, with the green light illuminating when the transfer media is properly aligned or past a certain location within the apparatus), or may be transmitted to a user interface device and presented in a graphical user interface.

In some embodiments, apparatus 100 may include a machine vision tracking system associated with transport mechanism 6, end effector 8, and/or substrate 10. The machine vision tracking system may include one or more cameras. In some embodiments, the one or more cameras may be mounted in a fixed position on transport mechanism 6, end effector 8, and/or substrate 10. Alternatively, the one or more cameras may be configured to move freely on transport mechanism 6, end effector 8, and/or substrate 10. In some embodiments, the machine vision tracking system may include an optical scanner and/or a timer. The machine vision tracking system may be configured to visually confirm that the transfer media is properly aligned on substrate 10. For example, an included camera, mirror system, or other configured structure may determine that an edge or other physical feature of a sheet of transfer media is aligned on substrate 10.

In some embodiments, apparatus 100 may include a product staging position 12. Product staging position 12 may constitute a platform, basin, magazine, or any structure/area that can receive and provide one or more products or accessories to be sublimated. When present, product staging position 12 may be a constituent part of apparatus 100, it may be adjacent to the apparatus, or it may be proximal to apparatus 100 but not in contact with its components. In some embodiments, staging position 12 is accessible by transport mechanism 6. In some embodiments, staging position 12 may be pre-configured to substantially match the dimensions of a selected product. For example, in some embodiments staging position 12 may include one or more dedicated areas or regions sized and shaped to readily fit one of each of a plurality of products available to the apparatus for sublimation. In other embodiments, staging position 12 may include a single area tailored to fit a single type of product. In still other embodiments, staging position 12 may include an area tailored to universally fit any product available to the apparatus for sublimation. Staging position 12 may be configured to receive products in an automated manner from other components of apparatus 100, or alternatively may be configured to receive products manually placed by a user (e.g., a store employee or a customer).

As part of the sublimation process, one or more selected products for sublimation may be placed on staging position 12 for introduction into apparatus 100. The products may be situated on staging position 12 permanently, or may be placed there either manually or automatically for purposes of a sublimation task. Controlled orientation of the product to be sublimated is important for completion of a high-quality sublimation task. To that end, products for sublimation may comprise packaging or other external features that permit proper localization and registration of the products within the apparatus at all times. The products, whether packaged or unpackaged, may nest within one another or within the defined tailored areas of staging position 12. Products for sublimation may be comprised of various materials. In some embodiments, the products may be comprised of plastic. In other embodiments, the products may be comprised of metal, such as aluminum, brass, or steel. In alternative embodiments, the products may be comprised of a ceramic material, a fabric or textile material, wood, fiberglass, or glass. In some embodiments, the product, regardless of its constituent material, may be additionally coated with a material to enhance integration and permanence of the sublimation dye, such as a polyester material. The added coating may be introduced to the surface of the product in various ways, such as spraying, dipping, painting, etc. In some embodiments, apparatus 100 may be configured to account for the thickness or hardness of the added coating. For example, if the coating is thinner and/or softer, the single thermal cycle of the apparatus may be adjusted accordingly to sublimate the product for slightly less time, or with slightly less pressure. Altering the thermal cycle in this manner preserves the quality of the sublimation transfer, and retains a glossy "sheen" on the sublimated product. Additionally, intermediate sheets of material may be placed between the heating platen and the transfer media to facilitate sublimation of materials with softer coatings, as will be further discussed below.

Possible candidate products and accessories for use in apparatus 100 may include, but are not limited to, luggage tags, pet tags, bookmarks, identification tags, dog tags, gift tags, ornaments, picture frames, picture frame inserts, cases for a mobile device, inserts for cases for a mobile device, various types of jewelry, such as pendants, bracelets, watch bands, earrings, necklaces, etc., fabrics, such as clothing, banners, draperies, etc., and any item that could integrate sublimation dye and bear a sublimated image. In some embodiments, products for sublimation in apparatus 100 are flat plates with opposing surfaces. In some embodiments, the products for sublimation may include keys, key heads, or key blades. In other embodiments, products could be flat, three-dimensional shapes, such as cubes. In still other embodiments, curved surfaces are possible. In these embodiments, products such as coffee mugs, decorative glass products such as vases or barware, sports balls, and medical identification bracelets could be candidates for receiving sublimated images. Candidate products for sublimation may be provided by the user, or they may be disposed within or proximal to the printing apparatus. In some embodiments, described in further detail below, the apparatus may be configured as a vending apparatus and the products may be situated inside of the apparatus. In some configurations, the vending apparatus may be capable of receiving a product inserted into the machine by a user. The apparatus may be further configured to receive, sublimate, and/or dispense accessory items that match or accompany candidate products for sublimation. The accessories, in a similar manner to the products, may be contained within the apparatus, proximal to the apparatus, or may be inserted into the apparatus by a user. In some embodiments, the inserted accessory may be a pre-packaged accessory designed to accompany the customized sublimated product.

As described, transport mechanism 6 may transport a selected product from staging position 12 to substrate 10. Mechanism 6, via end effector 8, may grasp the product with included mechanical features, such as claws, hooks, etc. For metallic products, end effector 8 may engage the product with magnets. In other embodiments, end effector 8 may use vacuum suction to pick up the product and hold it while transport mechanism 6 translates end effector 8 to substrate 10. Transport mechanism 6 may be configured to place the product to be sublimated onto a sheet of transfer media pre-aligned onto substrate 10. In alternative embodiments, transport 6 may be configured to place the product directly onto substrate 10 and place the transfer media on top of the product. Transport mechanism 6 may be configured to place the product directly onto one or more of the printed images printed onto the transfer media, and may be assisted in the process by one or more of the mechanical guides, mechanical switches, optical switches, machine vision systems, or cameras associated with substrate 10 described previously. In some embodiments, transport mechanism 6 may be further configured to manipulate the transfer media to substantially surround the product once it is oriented on substrate 10, with one or more printed images thereby positioned onto each side of the product to be sublimated. The manipulation may constitute folding the transfer media at its bisecting feature, and transport mechanism 6 may execute the folding process using mechanical implements associated with end effector 8.

Apparatus 100 may sublimate the printed images on the transfer media to selected products using heating platen 14. Apparatus 100 may contain one or more heating platens. In the embodiment illustrated in FIGS. 1 and 2, apparatus 100 contains a single heating platen. However, in alternative embodiments, more than one heating platen may be employed in apparatus 100, and substrate 10 may constitute a second heating platen. In alternative embodiments, multiple heating platens may be placed in series, with non-heated platens such as substrate 10 opposing each heated platen. Heating platen 14 may be comprised of any heat-conductive material, such as metal or ceramic. In some embodiments, heating platen 14 is comprised of cast iron, aluminum, or zinc.

Platen 14 may additionally be coated with a compliant material. Such a coating may comprise a foam, rubber, or plastic possessing the ability to maintain structural integrity under high temperatures and pressures. The compliant nature of the platen coating assists in the application of an even heat and pressure across all surfaces to be sublimated. Maintaining consistency of heat and pressure results in higher quality sublimated products, and reduces the risk of damage to either the product or the platen. In some embodiments, substrate 10 may be similarly coated with such a compliant material. In some alternative embodiments, heating platen 14 itself may have inherent flexibility, and may be capable of deformation across a product during sublimation to ensure even application of heat and pressure.

Apparatus 100 is configured to move heating platen 14 into contact with the transfer media as situated on substrate 10. Heating platen 14 may be configured as a pivoting assembly, such as that illustrated in the example of FIGS. 1 and 2. In such a configuration, heating platen 14 may pivot through an angular range of motion around a pin, bolt, or other fulcrum to contact the transfer media. In some embodiments, the pivoting mechanism may be machine-assisted. For example, heating platen 14 may include a hydraulic system, electrical actuator, pneumatic system, or combination thereof to control the rate of pivot of heating platen 14, and also assist with automation of the heating process. Such a system is optional, and is illustrated in the examples of FIGS. 1 and 2 as hydraulic system 16.

Heating platen 14 is operated by apparatus 100 in a single thermal cycle to sublimate the printed images from the transfer media onto the product. The single thermal cycle of heating platen 14 may be configured with a temperature, pressure, and duration sufficient to successfully transfer the image(s) to the selected product. The duration of the thermal cycle, measured as the dwell time of the platen on the transfer media, may vary based on the product to be sublimated, the transfer media, and the heating temperature of heating platen 14. In some embodiments, heating platen 14 is maintained at a temperature of about 400 degrees Fahrenheit for the entirety of the time that it is in contact with the transfer media. The pressure governing the single thermal cycle may be a defined, measured physical force. In some embodiments, the exerted pressure may be approximately 30-40 psi. Enough pressure must be exerted to sublimate the product without breaking it or damaging the heating platen. Thus, for products comprised of more brittle materials, such as ceramic, the pressure may be reduced compared to materials such as metal.

In some embodiments, the linear distance traveled by heating platen 14 may be monitored and programmed as part of the single thermal cycle in lieu of or in addition to the pressure. In some embodiments, system 100 may include a control unit for controlling the linear distance traveled by the one or more heating platens. Controlling the linear distance may be important for avoiding breakage of a sublimated product and/or damage to the heating platen or substrate. Such a measurement could be particularly useful in the sublimation of fragile, three-dimensional objects such as ornaments or jewelry. Linear distance may be measured in some embodiments as the distance between heating platen 14 and substrate 10. This linear distance may be preset for particular products based on their known dimensions. In such an embodiment, the movable heating platen, such as heating platen 14, may be pre-configured (e.g. through software executed by the control unit) to have a "hard stop" that achieves a desired linear distance from the substrate 10. In some embodiments, the temperature, pressure, and duration of the cycle are governed by the control unit (not shown) and software that automatically configures these parameters for the heating platen for a particular sublimation task. In some embodiments, the control unit is disposed within a user interface device (not shown) which is configured to determine the parameters.

The temperature, duration, and pressure of a heating platen 14 single thermal cycle may be determined based on a variety of predetermined criteria. In some embodiments, the predetermined criteria may include properties of the product being sublimated, including but not limited to dimensions of the product, the material comprising the product, the product's shape or curvature, etc. In some embodiments, the predetermined criteria may include characteristics of the printed images, including but not limited to pixel intensity or density of the printed image, colors utilized in the image, size of the image, etc. In some embodiments, heating platen 14 may be configured to provide differential heating based on the predetermined criteria; for example, one or more regions on heating platen 14 may be heated to a different temperature than one or more other regions on the platen. In other embodiments, the differential heating may comprise one or more regions on heating platen 14 that transmit heat for a different duration of time than one or more other regions on the platen. Different pressures may also be utilized. Pressure as used herein may refer to a programmed force configured by the control and exerted as a pressing force by heating platen 14, or it may relate to a position in three dimensional space achieved by heating platen 14 during the thermal cycle (e.g., rotation of a greater number of degrees by a pivoting platen assembly would indicate more pressure being exerted, or greater travel in the Y-dimension).

In alternative embodiments, heating platen 14 may be configured as a linear travel assembly rather than a pivoting assembly. Heating platen 14 may thus be disposed on one or more vertical rails, and its motion may be restricted to a single vertical direction. Such a configuration will be described below in association with FIGS. 3 and 4.

The single thermal cycle of heating 14 may be further governed by external factors, such as conditions within the establishment hosting apparatus 100. As discussed above, it is ideal that apparatus 100 be capable of operating within a conventional electrical power configuration, utilizing either a standard 120 volt plug or a dedicated 240 volt plug, such as that used in larger household appliances. Apparatus 100 must be capable of heating relatively quickly without exceeding or draining the power capacity of its host establishment. Therefore, in some embodiments where available power is limited, apparatus 100 and heating platen 14 may be configured in the control software with alternate automated warm-up and cool-down cycles to permit successful sublimation within an existing electrical configuration. In these embodiments, the apparatus may be flexibly reconfigured via the control software to integrate into various deployment environments without the need to replace, alter, or custom design hardware components.

Apparatus 100 may include a control unit to regulate the temperature of heating platen 14. In some embodiments, the control unit may be configured using software to automatically de-energize the heating platen in the event of heating platen failure or overheating over a threshold temperature. In these embodiments, the apparatus may further include a redundant secondary safety system independent of heating platen 14 and the control unit to de-energize the heating platen should both the heating platen and the control unit malfunction. The control unit may be the same control unit described previously that regulates the linear travel of heating platen 14, or it may be a separate control unit. In some embodiments, heating platen 14 may be consistently kept at its operating temperature. In other embodiments, heating platen 14 may be turned off and cooled down between each sublimation task. This configuration may be motivated by safety concerns or for energy efficiency. As an alternative, heating platen 14 may be configured to remain at an intermediate steady state temperature. In this embodiment, heating platen 14 may be configured to quickly increase its surface temperature from the steady state point to a sublimation temperature. Maintaining heating platen 14 at a temperature intermediate of ambient temperature (e.g. 200 degrees Fahrenheit) and sublimation temperatures (e.g. 350 degrees Fahrenheit) allows for quick ramping up to a sublimation temperature. Such a configuration may reduce the wait time to complete a sublimation task, which would lead to more profit-generating capability and more satisfied customers. The intermediate temperature should be selected such that the electronic and/or mechanical components of apparatus 100 internal to the housing are not adversely affected. To facilitate the variability of heating platen 14 temperatures, the control for heating platen 14 disclosed above may be configured to execute warm-up and cool-down cycles for the platen as needed.

In some embodiments, the control unit for heating platen 14 and/or user interface device associated with apparatus 100 may include a timer that governs the platen warm-up and cool-down cycles on a set schedule based on certain criteria. In some embodiments, the warm-up and cool-down cycles may be configured based on time of day or day of the week, to account for store traffic. For example, heating platen 14 may be kept at a higher steady state intermediate temperature (thus leading to a shorter warm-up cycle) on a Saturday afternoon versus a Tuesday morning because more traffic is likely in the host establishment on Saturdays. In other embodiments, the timer may monitor the time since the last sublimation task was completed, and may gradually cool down the platen accordingly. This functionality could be used to automatically shut down the heating platen at the closing time of the host establishment; the timer could be configured to shut the heating platen off completely after a certain number of hours have passed since the last sublimation job. Such a configuration promotes safety and energy efficiency without requiring constant supervision and monitoring of the platen temperature.

In some embodiments, the control unit for heating platen 14 may alter the configuration of the thermal cycle for the sublimation based on whether the sublimation task is single-sided or double-sided. The control unit may configure at least one of a programmed temperature, duration, pressure, or as described above, linear distance for heating platen 14 as part of the single thermal cycle. Although the range of sublimation temperatures may be relatively narrow, for energy efficiency purposes a slightly lower temperature may be utilized in a single-sided sublimation versus a double-sided, since there is no need for heat to penetrate through the thickness of the product.

Merely increasing the temperature of the thermal cycle is insufficient to sublimate opposing sides of a product simultaneously. While dramatically increasing the temperature of the heating platen when it engages the transfer media may heat the product enough to cause sublimation of the dyes, it likely also will result in overheating or melting of the transfer media onto the top surface, which, as described below, is necessarily hotter. To account for this narrow potential temperature range, the duration of the thermal cycle may be lengthened for double-sided sublimation due to thermal resistance within the material. For example, a material with low thermal resistance such as aluminum may have similar or identical thermal cycle durations for single versus double-sided sublimation; for example, in the range of fifty seconds in both cases. Materials with slightly higher thermal resistance, such as brass, may take slightly longer for double-sided sublimation. For example, double-sided brass sublimation may take sixty to seventy seconds versus fifty seconds for single-sided printing. On the extreme end of the equation is a material with high thermal resistance, such as some ceramic materials. Double-sided sublimation of these materials may require durations on the order of minutes rather than seconds. Apparatus 100 may be further configured to account for additional parameters in programming the single thermal cycle, such as the altitude where the apparatus is being used, different types or brands of transfer media, and different types or brands of sublimation dye.

Figure 14:
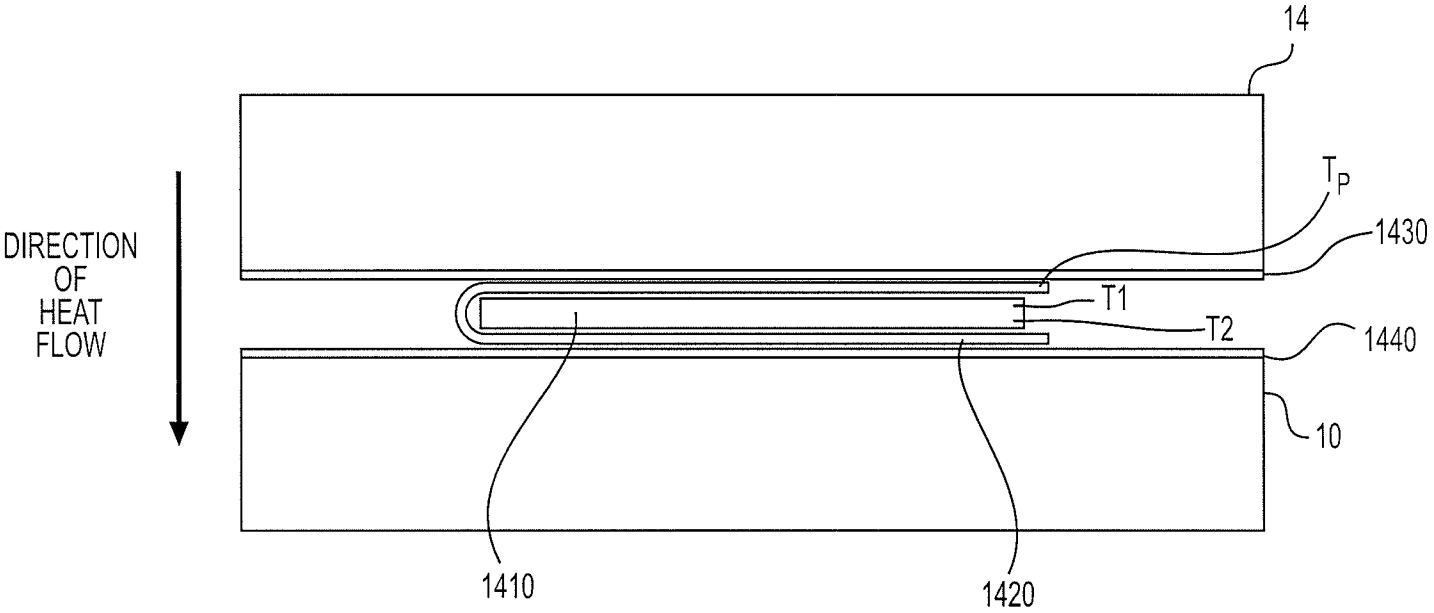
FIG. 14 is a diagrammatic illustration of a sublimation transfer process occurring simultaneously on opposing sides of a product, consistent with disclosed embodiments.

Regardless of the material used, thermal resistance of the material may directly impact the configured duration of the single thermal cycle when sublimating on opposite sides of a product. Such a scenario is depicted in FIG. 14. The control unit for heating platen 14 must configure at least the temperature and duration of the thermal cycle such that both sides of the product reach a sublimation temperature for a time sufficient to allow sublimation of the dye and saturation into the product. Thermal resistance of the product must be considered in configuration of the cycle because it necessarily creates a heating gradient within the material during the process. Therefore, apparatus 100 must account for the heat gradient, which may vary from product to product based on material composition. Different heat capacity, thermal conductivity, and glass transition temperature may all result in differing heat gradients from material to material. Even two products comprised of the same material may have different gradients based on the thickness of the material.

In the example illustrated in FIG. 14, product 1410 is being sublimated by apparatus 100. Heating platen 14 is engaged with transfer media 1420, which has been previously aligned on substrate 10. As heating platen 14 remains in contact with the top surface of transfer media 1420, heat flows through the product. Three temperatures indicative of the temperature gradient are illustrated in FIG. 14. Tp represents the temperature at the transfer media 1420, which directly contacts heating platen 14. Tp must remain below the maximum processing temperature at which transfer media 1420 is configured to operate without overheating. T1 and T2 are temperatures within the product 1410. The temperatures of material proximate the top of product 1410, such as T1, may necessarily be slightly higher than that of an area of the product proximate the bottom side closer to substrate 10 (and further from heating platen 14), such as T2. For a double-sided sublimation, T2 must be at least a minimum effective sublimation temperature to allow sublimation dye to permeate the coating of the side of the product proximate substrate 10. A minimum effective sublimation temperature is a temperature sufficient to incorporate sublimated dye into a desired product material to form an image. For a given material comprising product 1410, the difference between T1 and T2 is directly proportional to product 1410's thickness (e.g., the distance between the locations where T1 and T2 are sampled), and inversely proportional to the thermal conductivity of the material. Thick, poorly conductive materials like ceramic may therefore present a more substantial heat gradient and a larger difference between T1 and T2. For a piece of ceramic 0.14 inches thick, the difference between T1 and T2 may be as much as one hundred degrees Fahrenheit. In contrast, for a piece of aluminum four times thinner, the difference between T1 and T2 may be less than fifty degrees. Thus, for materials like ceramic, the single thermal cycle must be adjusted to account for the broader heat gradient of the material.

Heating platen 14 is configured to execute the single thermal cycle in a manner that sublimates printed images onto all desired sides of the selected product substantially simultaneously. Such a configuration streamlines and expedites the sublimation process, and provides the capability to provide a wide range of customized and personalized sublimation products. Advantages to printing opposing sides of a product simultaneously include increased efficiency, reliability, and repeatability of the process. Wear on the system is essentially halved, and thus the life of the machine should be increased and maintenance costs and down time should be reduced. The reduced time taken to sublimate a product for a customer enhances the attractiveness of the product offering in a retail environment; a customer is more likely to purchase a product if the product can be sublimated quickly. Moreover, quicker production time increases the revenue-generating capability of the machine, as less time per sublimation job means more jobs can be completed during operation hours. Sublimating both sides in a single thermal cycle is also an advantage because it increases the consistency of the transfer process. Again, reducing the number of processes and the complexity of such processes will extend the working life of a sublimation printing apparatus.

To facilitate double-sided sublimation in a single thermal cycle, the duration of the cycle may be altered depending on the thickness of the product. As discussed above, the programmed duration must account for the heat gradient and thermal resistance within the material comprising the product, and must ensure that all surfaces of the product are exposed to a proper sublimation temperature as discussed above without overheating, warping, or otherwise damaging the platen, the product, or the transfer media. In some embodiments, an intermediate sheet of material 1430 may be placed between heating platen 14 and the transfer media 1420 to further even out heat and pressure across the surface of the item to be sublimated. The intermediate sheet 1430 may help prevent the transfer media 1420 from sticking to heating platen 14, which could smudge or blur the transferred image. The intermediate sheet 1430 may be comprised of a material capable of resisting high temperatures without losing structural integrity, such as a thermal tape, or a textile. When present, this intermediate sheet 1430 may protect both the product and the apparatus, and increase reliability and repeatability of the sublimation process. In some embodiments, the intermediate sheet 1430 may remain associated with heating platen 14, and may not be removed after each individual sublimation task. In other embodiments, the intermediate sheet 1430 may be transported to substrate 10 and aligned and registered by transport mechanism 6 and end effector 8. As discussed above, in some embodiments substrate 10 may be coated or covered with a pad 1440 comprising a thermally insulating material, such as a thermal neoprene or a foam rubber, to minimize unwanted heat transfer and loss during the sublimation process.

In some embodiments, heating platen 14 may be configured as a linear travel assembly rather than a pivoting assembly. Heating platen 14 may thus be disposed on one or more vertical rails, and its motion may be restricted to a single vertical direction. Such a configuration will be described below in association with FIGS. 3 and 4.

Apparatus 100 may be configured to automatically dispose of the used transfer media from substrate 10 after heating platen 14 is translated away from substrate 10. In some embodiments, transport mechanism 6 and end effector 8 may be configured to pick up, slide, or otherwise move the used transfer media off of substrate 10. In some embodiments, apparatus 100 may include a dedicated waste collection bin to receive the used transfer media. In other embodiments, the waste may be manually collected by an operator.

In some embodiments, apparatus 100 includes an optional cooling system, an example of which is illustrated in FIGS. 1 and 2 as cooling system 18. In some embodiments, cooling system 18 may be configured to cool the sublimated product to at least about an ambient temperature. The cooling process provides safety for handlers of the sublimated object, and also helps ensure the quality and permanence of the sublimation transfer by preventing smearing, blistering, etc. In some embodiments, cooling system 18 may constitute a heat sink. Cooling system 18 may also be configured as an active cooling system. For example, as illustrated in FIG. 2, cooling system 18 may include one or more fans in addition to a heat sink. The example of FIG. 2 illustrates cooling system 18 as a perforated metal plate with a fan disposed beneath the plate. Further detail of an exemplary cooling system is described below and illustrated in FIG. 7. In some embodiments, cooling system 18 may be configured to sense whether the sublimated product is cooled to the desired temperature. In other embodiments, cooling system 18 may be configured to allow the product to cool for a predetermined duration of time. In such configurations, cooling system 18 and/or other components of apparatus 100 may be capable of preventing access to the product by a user or consumer until the product is sufficiently cooled. In other embodiments, cooling system 18 may include additional or alternative active cooling elements, including but not limited to a Peltier plate, a Peltier bath, spraying or immersion in liquids such as water, liquid nitrogen, etc., and a heat exchanger. In some embodiments, transport mechanism 6 may actively transport the sublimated product through a forced convection cooling field. In other embodiments, cooling system 18 may incorporate a passive method of cooling a sublimated product, such as simply allowing the product to cool over time to room temperature. In other embodiments, the passive cooling technique may cool the product via conduction, and may include placing the sublimated product in contact with a panel comprised of a material with high heat capacity and thermal conductivity, such as copper, brass, aluminum, or steel. In some embodiments, the passive cooling system may include components or elements that are capable of cooling the product through convection.

Transport mechanism 6 (including head 8) may be configured to transport the sublimated product from substrate 10 to cooling system 18. Alternatively, substrate 10 may be capable of rotation or translation to provide the product to system 18. Further, after cooling system 18 has cooled the sublimated selected product to about an ambient temperature, transport mechanism 6 may be configured to transport the cooled sublimated product to a final location for pickup by the user. For example, apparatus 100 may include an optional delivery opening 20. Alternatively, cooling system 18 may be capable of rotation or translation to provide the cooled product to an included dispensing chute 20. As a non-limiting example, in FIGS. 1 and 2, the plate of cooling system 18 is mounted on a pin and is capable of pivoting, thus dropping a cooled product into delivery opening 20. As discussed above, delivery opening 20 may be configured, in concert with cooling system 18 or other components of apparatus 100, to restrict access to the sublimated product by the user until certain conditions are satisfied. For example, delivery opening 20 may prevent access to the product until it is sufficiently cooled, until payment has been coordinated and collected, or until the user has been prompted about additional product or service opportunities.

In some embodiments, apparatus 100 may include an associated user interface device (not shown). The user interface device may be configured to assist an operator in selecting one or more images to print on the transfer media, selecting one or more products on which to sublimate the printed images, controlling aspects of the sublimation process, and coordinating payment for the product. An exemplary user interface device will be described below in association with FIG. 8.

In some embodiments, apparatus 100 may further include a housing (not shown in FIGS. 1 and 2), the housing configured to enclose some or all of the components of apparatus 100 in a manner that prevents an operator from contacting the enclosed components. The housing may be comprised of metal, plastic, glass, or a combination thereof. The optional housing may serve several important functions: it protects the operator (or others) from burn, pressure, pinch, or puncture injuries that could occur as a result of contact with the apparatus components. Further, the housing protects the apparatus itself, shielding the components from wear and tear and keeping them clear of dust, insects/animals, etc. When equipped with an optional housing, delivery opening 20 may be configured to provide the product to an operator or another party outside of the housing.

As discussed above, when configured as a full kiosk, the housing protects the operator and other individuals who may encounter the machine. Heating platen 14 may be disposed within the housing such that it does not touch any of the housing walls, so as to maintain the external surface of the housing at a temperature safe for touch. Additionally, in some embodiments the housing may be equipped with a ventilation system. The ventilation system may result in ambient air flowing into the machine, either by natural convection or by forced convection, such as through a series of fans. In embodiments where the housing is configured to contain a ventilation system, the ventilation system may be further configured to interface with a larger ventilation system for the retail establishment or other structure hosting the apparatus. A ventilation system may permit heating platen 14 to be kept at a steady state intermediate temperature or even at full operational temperature, without creating burn risks to users or excessively raising the ambient temperature of the surrounding air. In some embodiments, the ventilation system may be configured to control a temperature within the housing such that the mechanical and electrical components of apparatus 100 are protected from damage and the exterior surface of the housing remains touch-safe. Allowing the enclosed components, including heating platen 14, to remain at an intermediate but safe temperature reduces system warm-up time and customer wait time.

The housing also may have value-added functions for the entity hosting the apparatus. In some embodiments, the housing may feature a decorative design that appeals to customers and attracts interest and business. The design could be proprietary to the maker of the apparatus, or could be designed by the entity hosting the apparatus. The housing may be configured such that a portion of the enclosure is transparent. Such a configuration provides entertainment and education to the user while the sublimation task is underway, and may also allow an operator to take note of components of the apparatus requiring maintenance or repair. As discussed above, offboard configurations of the apparatus may also optionally include such a housing, depending on the needs of the user.

The modular subsystem features of the apparatus promote deployment of the apparatus in a variety of ways. The apparatus may be suitable for customizable footprints to meet the needs of the hosting entity. For example, if the apparatus must fit in the corner of a room, the modular design may permit the device to wrap around the corner. A "countertop" configuration might be a good fit for a jewelry counter at a department store. The subsystem configuration increases the flexibility and versatility of the apparatus and increases the market possibilities for the invention.

Figure 3:
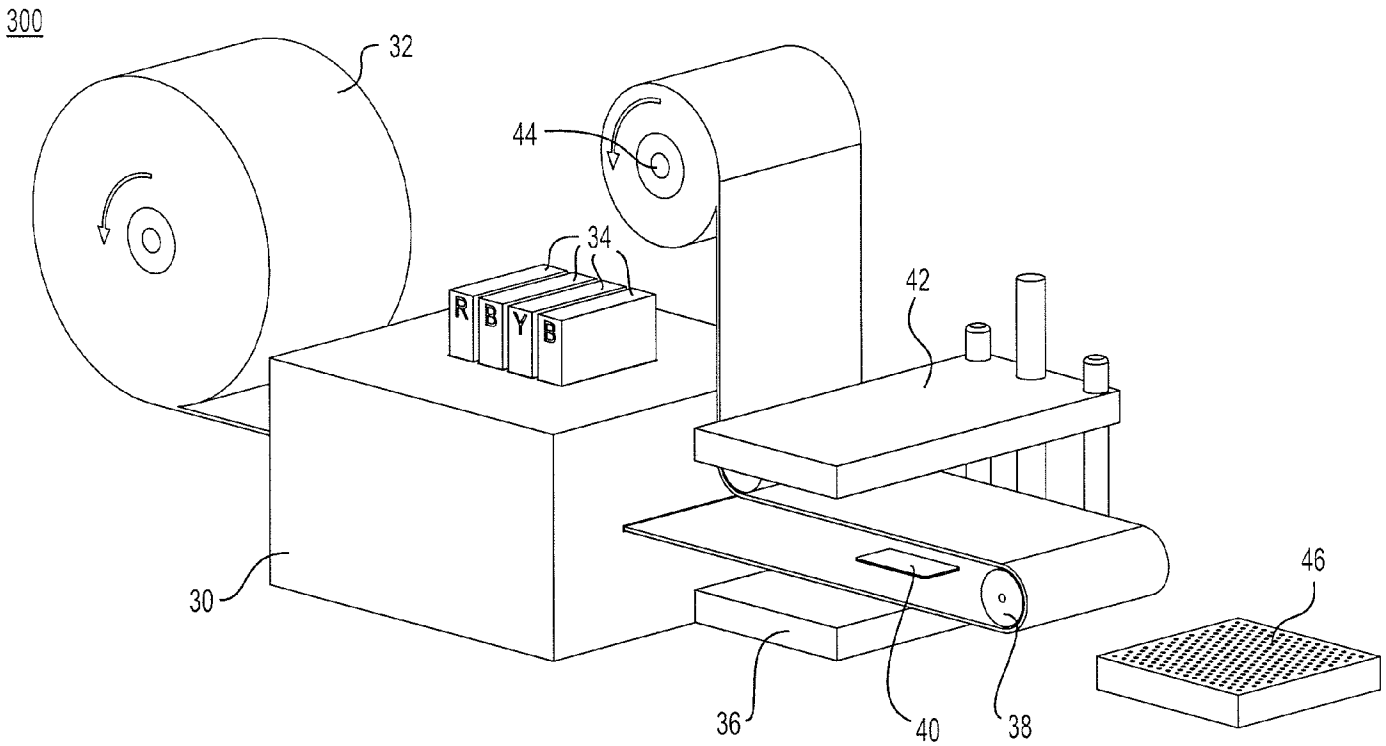
FIG. 3 is a profile view of an exemplary integrated dye sublimation printing apparatus consistent with disclosed embodiments.
Figure 4:
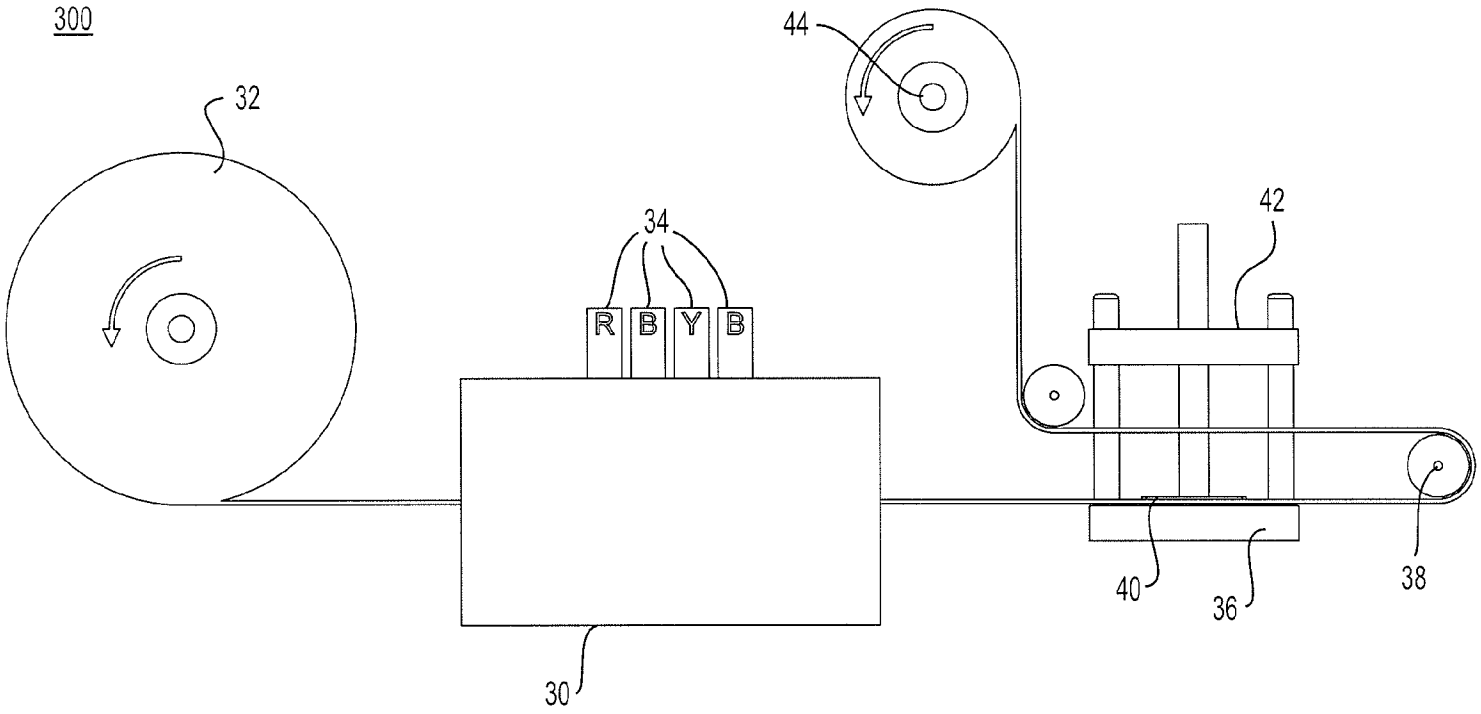
FIG. 4 is a front view of the dye sublimation transfer printing apparatus of FIG. 3.

FIGS. 3 and 4 illustrate another exemplary dye sublimation transfer printing apparatus 300. Apparatus 300 as illustrated is configured substantially in the same manner as apparatus 100 described above, but with several alternative components to those described above. As the apparatus contemplated by the invention is modular in its nature, the various components of apparatuses 100 and 300 are not limited to those illustrated configurations, and an apparatus constituting features from each of the illustrated embodiments in FIGS. 1-4 is within the scope of the invention.

Apparatus 300 includes a printer 30 for printing images onto transfer media. Printer 30 is substantially the same as printer 2, described above in association with FIGS. 1 and 2, with the exception that printer 30 is configured to print images onto rolls of transfer media rather than the individual sheet configuration of printer 2. Supply roll 32 provides the transfer media to printer 30. As illustrated, roll 32 may be mounted onto a spindle or pin so that it is substantially stationary, and unwinds in a counter-clockwise direction to provide a flat surface of transfer media to printer 30. In alternative embodiments, roll 32 may unwind in a clockwise direction, and one or more intermediate rollers (not shown) may be disposed between roll 32 and printer 30 for purposes of orienting and flattening the transfer media as it enters printer 30. Printer 30 may be configured to automatically feed the roll of transfer media into proximity with the print head and sublimation dyes for printing, which are illustrated in FIGS. 3 and 4 as print cartridges 34. Alternatively, printer 30 may be configured as a manual, hand-fed printer in which an operator may unroll a predetermined amount of transfer media and feed it manually into printer 30. Some embodiments of printer 30 may be capable of both manual and automatic sheet feeding. In some embodiments, apparatus 300 may be configured to include more than one roll 32 and/or more than one printer 30 to optionally increase output capabilities.

Printer 30 may be configured to print a dye image on the transfer media in a configuration to permit subsequent simultaneous sublimation on multiple sides of a product. To support this capability, printer 30 may be configured with more than one print head and more than one set of print cartridges 34. Printer 30 may be configured to print the selected images in a single pass, or may require two passes, such as for complex images, multiple colors, or multiple layers of images. For example, a printed dye image may include multiple distinct images superimposed into a single image. Printer 30 may print the superimposed image in a single pass, or may print each constituent image in its own pass through the machine.

Printer 30 and transfer media from roll 32 may interface with a feed line comprising a series of guides and rollers that may lead the sheet to the next component of the apparatus. Such rollers may be manual, or may be mechanized and operated automatically by a control (not shown).

In the example illustrated in FIGS. 3 and 4, the printed transfer media is fed out of printer 30 across substrate 36, which may be configured substantially the same as substrate 10 described above. After feeding the section of the transfer media containing one or more images to be sublimated onto the top surface of a product over substrate 36, the printed transfer media is fed over roller 38 such that it doubles back on itself. In some embodiments, the position or diameter of roller 38 may be variable, to accommodate various system configurations and products of different shapes and sizes. Apparatus 300 may be configured to continue to feed the printed transfer media across substrate 36 and over roller 38 until the images to be sublimated on opposing sides of a product, such as product 40, are substantially aligned relative to one another and to product 40. Registration of the transfer media may occur by tactile or digital feedback systems. In some embodiments, the rolled transfer media may contain indicia or fiducial marks on the media that are machine-readable and indicate to apparatus 300 when to halt feeding of the transfer media. Substrate 36 or an optional transport mechanism may be equipped with non-contact optical scanners and/or cameras (such as those described above with respect to apparatus 100, transport mechanism 6, and substrate 10) to read the indicia on the transfer media. In alternative embodiments, the transfer media may be tractor-fed and apparatus 300 may be configured to feed the transfer media a certain distance based on a predetermined number of perforated holes in the unprinted margins of the transfer media.

Apparatus 300 may include an active transfer mechanism (not shown), such as transport mechanism 6 and end effector 8 described above. As described, such a transport mechanism may transport a selected product from an optional staging position (not shown) to substrate 36. The transport mechanism may be configured to place product 40 onto unrolled, printed transfer media pre-placed and pre-aligned onto substrate 36. The transport mechanism may be configured to place product 40 directly onto one or more of the printed images printed onto the transfer media, and may be assisted in the process by one or more of the mechanical guides, mechanical switches, optical switches, or machine vision systems associated with substrate 36 described previously with respect to substrate 10. In other embodiments, product 40 may be manually placed by an operator onto substrate 36 in the proper position and alignment for sublimating. As discussed above, the transport mechanism may be configured to facilitate alignment and sublimation of the transfer media and the product. The transport mechanism may manipulate the transfer media to substantially surround the product, and ensure that at least one image is disposed on or near each side of the product to be sublimated.

Apparatus 300 may sublimate the printed images on the transfer media to selected products using heating platen 42. Apparatus 300 may contain one or more heating platens 42. In the embodiment illustrated in FIGS. 3 and 4, apparatus 300 contains a single heating platen. However, in alternative embodiments, more than one heating platen may be employed in apparatus 300, and substrate 36 may constitute a second heating platen. In alternative embodiments, multiple heating platens may be placed in series, with non-heated platens such as substrate 36 opposing each heated platen. Heating platen 42 is configured substantially the same as heating platen 14, with the exception that heating platen 42 as shown in FIGS. 3 and 4 is configured to move linearly, and is not pivotable. The linear motion of heating platen 42 may be controlled manually, or may be controlled by other means such as a stepper motor, hydraulic system, electrical actuator, pneumatic system, or combination thereof (not shown).

As discussed above in relation to heating platen 14, heating platen 42 is operated by apparatus 300 in a single thermal cycle to sublimate the printed images from the transfer media onto the product. The single thermal cycle of heating platen 42 may be configured with a temperature, pressure, and duration sufficient to successfully transfer the image(s) to product 40. In some embodiments, the temperature, pressure, and duration of the cycle may be governed by a control (not shown) and software that automatically configures these parameters for the heating platen for a particular sublimation task, particularly in double-sided printing embodiments where the duration of the cycle must be carefully configured and monitored. In some embodiments, the control is disposed within a user interface device (not shown) which is configured to determine the parameters. Like heating platen 14, heating platen 42 may be configured to provide differential heating based on predetermined criteria such as properties of product 40 or characteristics of the printed image(s).

Heating platen 42 is configured to execute the single thermal cycle in a manner that sublimates printed images onto all desired sides of the selected product substantially simultaneously. As discussed above, such a configuration streamlines and expedites the sublimation process, and provides the capability to provide a wide range of customized and personalized sublimation products.

The used transfer media may be fed away from roller 38 and substrate 36 onto roller 44 after heating platen 42 has released contact with the media and transferred the images onto product 40. In some embodiments, the optional transport mechanism may be configured to remove product 40 from the media, or substrate 36 may be configured to pivot or translate to move product 40 off of the media. After product 40 has been removed, roller 44 may be rolled in the same direction as roll 32 to collect the used media for future disposal. Roller 44 may, in some embodiments, also be utilized to move transfer media throughout the entire apparatus 300. Roller 44 may be configured to be rolled manually, or automatically by a control.

In some embodiments, apparatus 300 includes an optional cooling system, illustrated in FIGS. 3 and 4 as cooling system 46. Cooling system 46 may be configured substantially the same as cooling system 18 described above. After cooling system 46 has cooled the product 40 to about an ambient temperature, an optional transport system may be configured to transport the cooled sublimated product to a final location for pickup by the user. For example, apparatus 300 may include an optional delivery opening (not shown).

As with apparatus 100, in some embodiments, apparatus 300 may include an associated user interface device (not shown). The user interface device may be configured to assist an operator in selecting one or more images to print on the transfer media, selecting one or more products on which to sublimate the printed images, controlling aspects of the sublimation process, and coordinating payment for the product. In some embodiments, apparatus 300 may further include a housing (not shown in FIGS. 3 and 4), the housing configured to enclose some or all of the components of apparatus 300 in a manner that prevents an operator from contacting the enclosed components. When equipped with an optional housing, the optional dispensing chute may be configured to provide the product to an operator or another party outside of the housing. In the "roll" configuration illustrated in FIGS. 3 and 4, transfer media rolls 32 and 44 may also optionally be disposed outside of the housing in order to facilitate replacement by an operator. Alternatively, the housing may be accessible by the operator and the rolls may be disposed within the housing.

Figure 6:
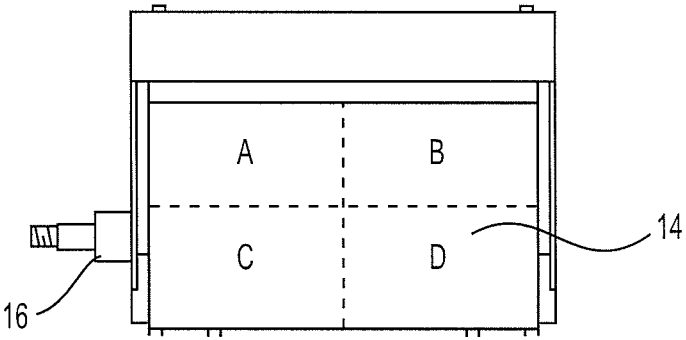
FIG. 6 is a diagrammatic illustration of an exemplary heating platen assembly consistent with disclosed embodiments.
Figure 5:
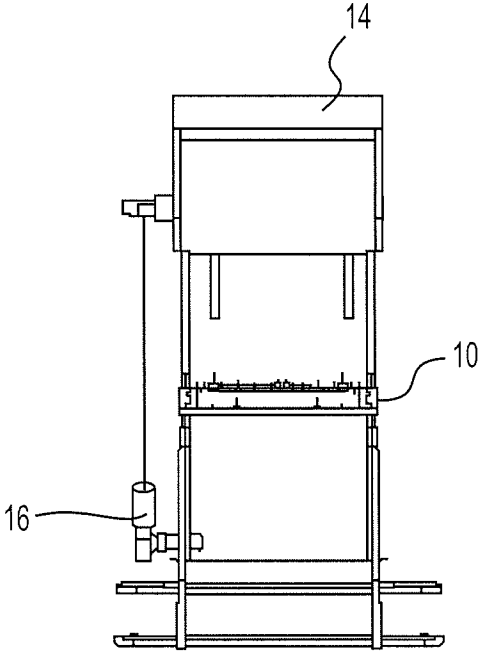
FIG. 5 is a diagrammatic illustration of an exemplary heating platen assembly consistent with disclosed embodiments.

FIGS. 5 and 6 illustrate additional views and perspectives of the single heating platen 14 described above in relation to FIGS. 1 and 2. FIG. 5 is a side view of heating platen 14 and related components. Hydraulic system 16 is illustrated in further detail, and as shown in FIG. 5 comprises a hydraulic cylinder, a linker (which may be a cam, cable, etc.), and a connector to the platen, such as a pin or bolt.

FIG. 6 illustrates how regions on the surface of heating platen 14 might be delineated for purposes of the differential heating capabilities described above. In FIG. 6, four regions A-D are illustrated on the surface of heating platen 14. Such delineation may be formal and of a structural nature, with the platen surface physically cut or segregated into the different regions. In other embodiments, the delineation of regions may be performed electronically by a control and software system, and no physical evidence of the regions may be visible on the surface of platen 14. The electronic delineation would permit rapid re-setting of region boundaries and parameters between sublimation jobs, or even within different phases of the same sublimation job. The illustration of FIG. 6 is an example configuration only and should not be taken to represent actual boundaries of any particular heating platen 14.

Figure 7:
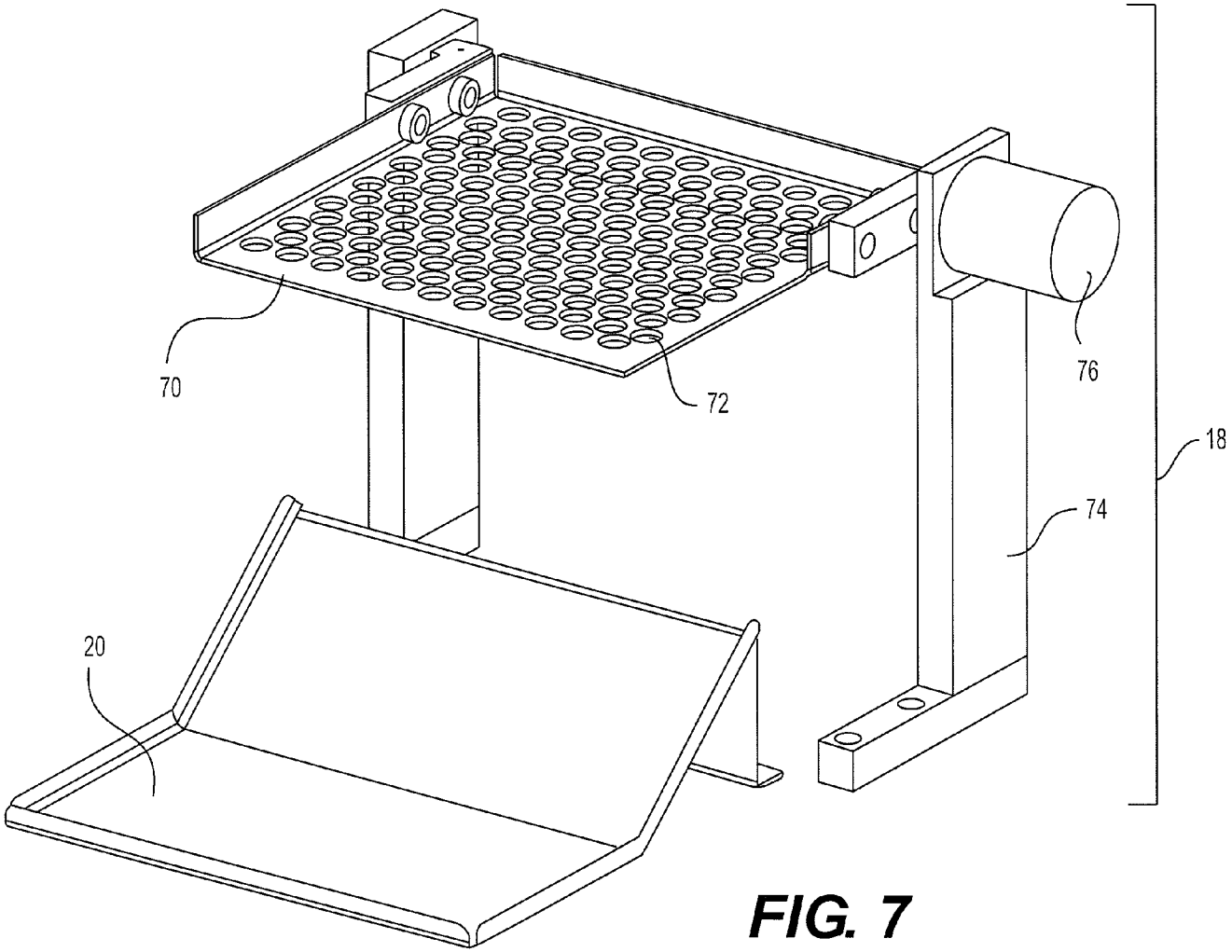
FIG. 7 is a diagrammatic illustration of an exemplary cooling and dispensing assembly consistent with disclosed embodiments.

FIG. 7 is a detailed view of one exemplary embodiment of a cooling system 18, as shown in FIGS. 1 and 2 and discussed in detail above. In some embodiments containing a cooling system, a sublimated product may be placed onto perforated plate 70. Plate 70 contains a plurality of holes 72, to permit ambient cooling or facilitate active cooling. Plate 70 may be mounted onto frame 74 and secured on one end by pin 76, on which plate 70 may be configured to pivot. In some embodiments, as discussed previously, cooling system 18 may be configured to manually or automatically drop a cooled product from cooling system 18 into delivery opening 20 by allowing plate 70 to pivot around pin 76. In some embodiments, cooling system 18 may also contain additional components to facilitate cooling, such as one or more heat sinks, fans, baths, spraying nozzles, etc. (not shown). In some embodiments, when configured as a passive cooling system, a heat sink associated with cooling system 18 may comprise a mass of a thermally conductive material with high heat capacity. In some embodiments, the thermally conductive material may be aluminum, brass, copper, or steel.

Figure 10:
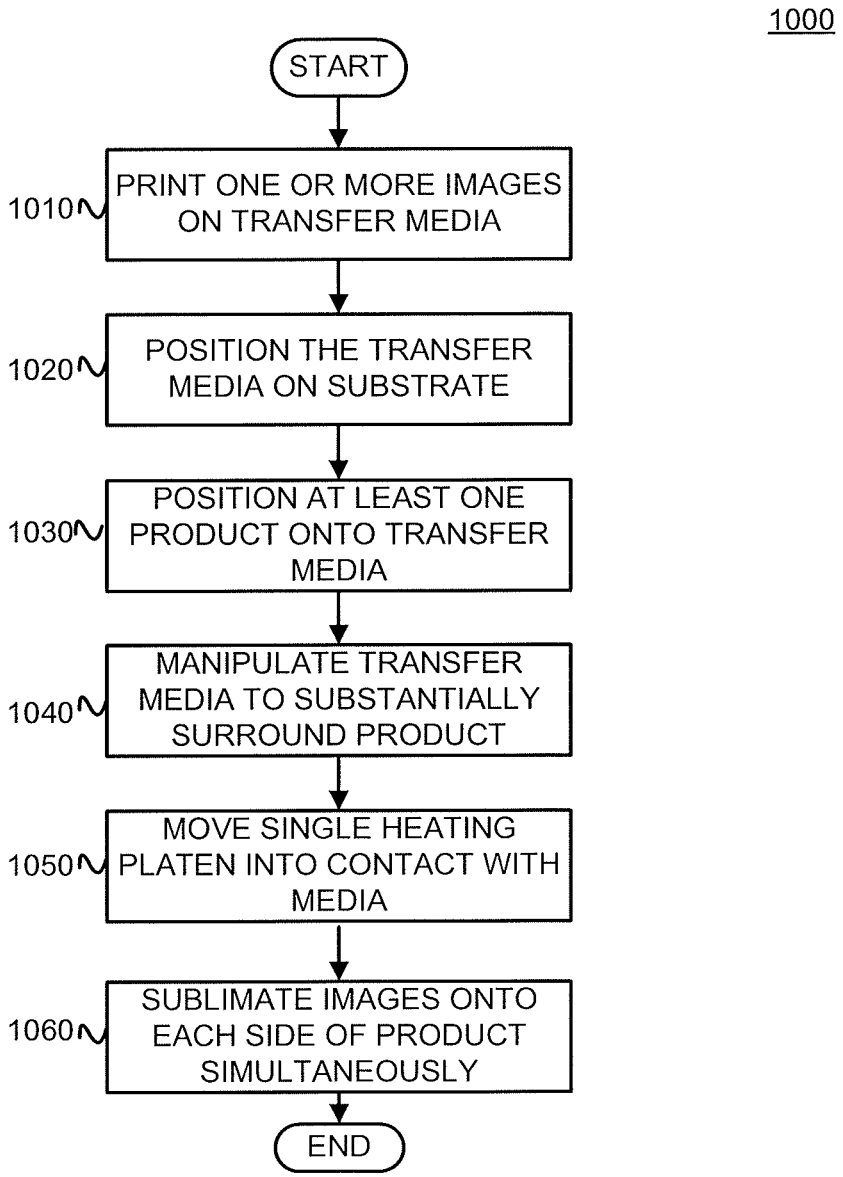
FIG. 10 is a flowchart of an exemplary dye sublimation transfer printing process, consistent with disclosed embodiments.

The apparatuses contemplated by the invention, including the illustrated examples of FIGS. 1-7, may be configured to perform a single platen double-sided sublimation process, such as that shown in the example of FIG. 10. The steps of the process may be performed in any order; the embodiment illustrated in FIG. 10 is intended to be exemplary only. FIG. 10 will be described in connection with dye sublimation printing apparatus 100, but it is understood that other configurations are within the scope of the invention, such as that illustrated in FIGS. 3 and 4 as dye sublimation printing apparatus 300. The single platen double-sided sublimation process can also be configured to operate in a vending embodiment, which will be described below in association with FIGS. 8 and 11. In one embodiment, apparatus 100 may print one or more images on a transfer media (Step 1010). The images are printed onto the transfer media by printer 2. In some embodiments, the image(s) may be a user provided image received through a configured user interface device. In other embodiments, the image(s) may be stock images preloaded into the memory of the user interface device. In still other embodiments, the image(s) may constitute text input received by the user interface device. In yet other embodiments, the image(s) may be captured by a camera associated with apparatus 100 and the user interface device. The image(s) may also represent a combination or composite of the above described options.

Apparatus 100 may position the transfer media onto a substrate, such as substrate 10 (Step 1020). As discussed above, in some embodiments, the transfer media may comprise sheets of transfer media configured to include a bisecting feature, and are deposited onto tray 4 after being printed by printer 2. In some embodiments, an optional transport mechanism, such as transport mechanism 6, may move the printed sheet of transfer media from tray 4 to substrate 10. As discussed, in alternative embodiments, system 100 may be configured to move the transfer media to substrate 10 in a variety of ways. Once placed in proximity to substrate 10, apparatus 100 may position and align the transfer media on the substrate using one or more of the components described above, such as mechanical guides, mechanical switches, optical switches, machine vision systems, or a combination of one or more such components.

Apparatus 100 may position at least one product onto the transfer media (Step 1030). In some embodiments, the product is placed automatically by apparatus 100 onto staging position 12, and then transport mechanism 6 (via head 8) transports the product from staging position 12 to substrate 10. In other embodiments, either the placement of the product onto staging position 12 may be manual, the transport of the product to substrate 10 may be manual, or both. In some embodiments, positioning the product may constitute head 8 grasping the product by suction, transporting it to the substrate, and aligning it with respect to the transfer media. Alignment of the product on the transfer media may also utilize one or more of the mechanical guides, mechanical switches, optical switches, and machine vision systems described above.

The optional transport mechanism, such as transport mechanism 6, may further be configured to manipulate the transfer media to substantially surround the product, wherein at least one printed image is positioned on each side of the product (Step 1040). Transport mechanism 6 may manipulate the media using head 8. Head 8 may be configured to include mechanical implements to manipulate the media, such as pegs, hooks, etc. Apparatus 100 may be configured to manipulate the transfer media by folding the media along the bisecting feature. Upon folding the media, one or more images may be positioned proximal to each side of the product to be sublimated.

Process 1000 continues with apparatus 100 moving a single heating platen, such as heating platen 14, into contact with the transfer media (Step 1050) and sublimating the one or more printed images onto opposing sides of the product substantially simultaneously in a single thermal cycle (Step 1060). In some embodiments, the single thermal cycle may further include a predetermined pressure. In some embodiments, parameters for the single thermal cycle that enable simultaneous printing on multiple sides of a product may be determined automatically by apparatus 100. The parameters may be based on one or more of the material comprising the product, the dimensions of the product, characteristics of the printed images, or other predetermined criteria.

Figure 8:
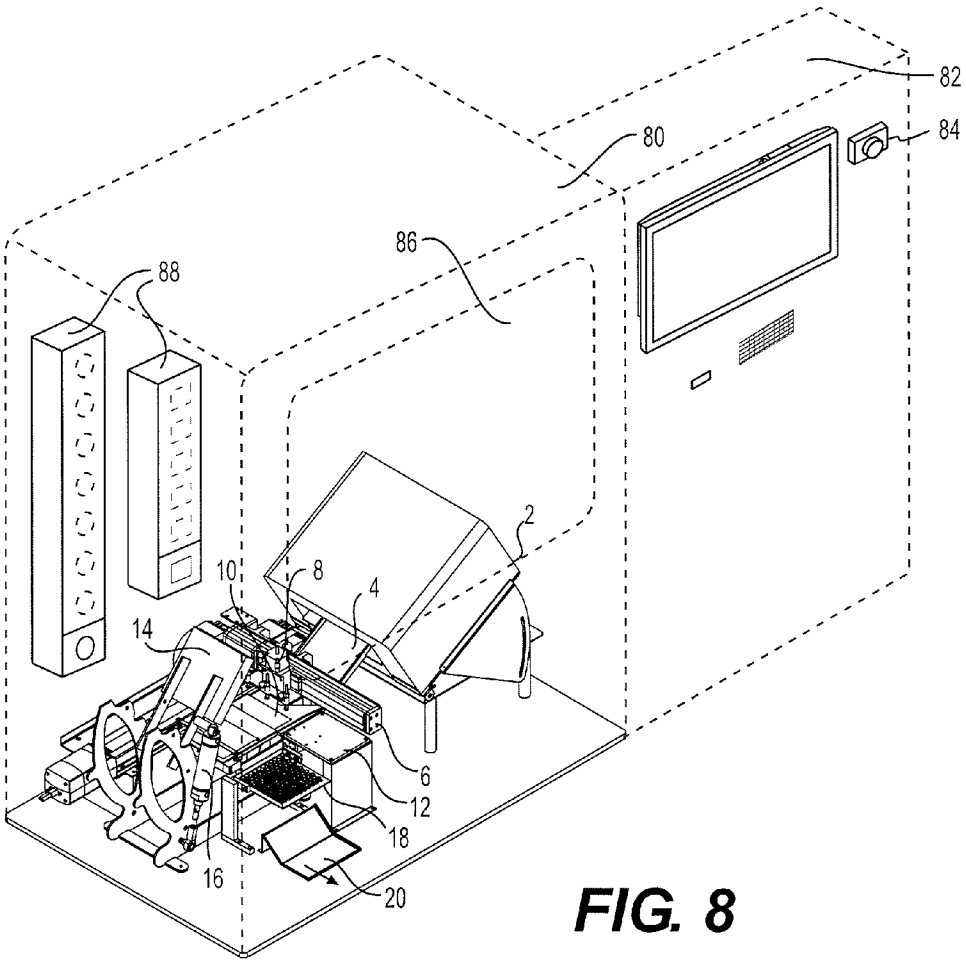
FIG. 8 is a diagrammatic illustration of an exemplary integrated dye sublimation transfer printing vending machine consistent with disclosed embodiments.

FIG. 8 illustrates the integration of an apparatus 800 similar to apparatus 100 or apparatus 300 into a housing 80 configured to permit operation of the apparatus in the manner of a vending machine. In the example shown in FIG. 8, a modified apparatus 100 (a sheet-fed sublimation printer system) is situated within housing 80. Components of the apparatus within the vending machine are substantially as described above and as depicted in FIGS. 1 and 2, with several additional features added to adapt the apparatus to a fully automated, fully contained, integrated embodiment operable by an untrained consumer safely at a point of sale in a retail setting. For example, delivery opening 20 may be disposed relative to housing 80 such that a portion of the opening extends out from the housing, such that the consumer may retrieve the sublimated product. Additionally, printer 2 is configured to maintain a supply of a plurality of sheets of transfer media. Also included within housing 80 is one or more magazines 88, which may be configured to store a plurality of products of different types. Magazine 88 may include one or more openings to dispense one of the stored plurality of products when a particular product is selected by the user. Magazine 88 may be disposed within the housing such that it is adjacent or proximal to staging position 12, and in a manner such that transport mechanism 6 (including end effector 8) or some other mechanism may readily access magazine 88 to transport a selected product from magazine 88 to staging position 12. In some embodiments, magazine 88 may be movable, and may be configured to feed a product directly onto substrate 10 or staging position 12. In some embodiments, vending apparatus 800 may contain multiple magazines 88. Each magazine may contain one type of a plurality of types of products. In other embodiments, one or more magazines 88 may be configured to store included accessories for sublimated products. Examples include, but are not limited to, key rings or key chains, covers or holders for luggage tags, frames, handles, etc. In some configurations, stand-alone accessories may also be contained in magazine 88, or may be introduced to the apparatus by a user. Accessories may serve as value-added components that add to the aesthetics or utility of the sublimated product. The accessories themselves may or may not be sublimated. Accessories may or may not be dispensed at the same time as the sublimated product. For example, one user may customize both a sublimated product and a matching accessory. Another user might purchase and customize only a sublimated product. Finally, another user might purchase and customize a sublimated product, and return to vending apparatus 800 at a later time to purchase one or more accompanying accessories for the product. As discussed above, the accessories may be pre-packaged, and inserted into vending apparatus 800 by the user before, during, or after the sublimation of the product. When inserted, transport mechanism 6 may be configured to receive the inserted accessory and orient it within the apparatus for the desired function.

Housing 80 may be configured as discussed above to include a control unit to regulate the temperature of heating platen 14. Maintaining heating platen 14 at a temperature intermediate of ambient temperature (e.g. 200 degrees Fahrenheit) and sublimation temperatures (e.g. 350 degrees Fahrenheit) allows for quick ramping up to a sublimation temperature. Housing 80 may further include ventilation components or systems. When present, these systems may interface with other ventilation systems in the retail establishment hosting vending apparatus 800. The ventilation components may be configured to control a temperature within the housing such that the mechanical and electrical components of vending apparatus 800 are protected from damage and the exterior surface of the housing remains touch-safe. Allowing the enclosed components, including heating platen 14, to remain at an intermediate but safe temperature reduces system warm-up time and customer wait time.

Vending apparatus 800 may include a user interface device 82. User interface device 82 may be configured with various capabilities to facilitate the various steps of a sublimation task. User interface device 82 may include a variety of components to control other components of apparatus 800. Device 82 may contain a computing system (not shown), which may further comprise one or more processors and one or more internal memory devices. The one or more processors may be associated with control elements of apparatus 800 that position and operate the various components. The memory devices may store programs and instructions, or may contain databases. The memory devices may further store software relating to a graphical user interface, which device 82 may display to the user on an output screen. The computer system of user interface device 82 may also include one or more additional components that provide communications to other entities or systems via known methods, such as telephonic means or computing systems, including the Internet.

User interface device 82 may include input and output components to enable information associated with the sublimation task to be provided to a user, and also for the user to input required information. In some embodiments, the input components may include a physical or virtual keyboard. For example, in the example of FIG. 8, a consumer may first be prompted by device 82 to determine one or more images to be printed by printer 2 onto sheets of transfer media. Device 82 may be configured to receive a user-provided digital image file in various ways, including but not limited to receiving insertion of flash memory or a USB drive, connecting via a USB or Firewire® cable, receiving image files by email, receiving image files uploaded via a mobile application, retrieving user-submitted image files from an online library or website, etc.

In some embodiments, device 82 may be capable of outputting audible notifications or alerts to a customer or operator of vending apparatus 800. For example, device 82, via transport mechanism 6 and/or substrate 10, may receive a notification that the transfer media is misaligned or jammed based on a lack of registration of a fiducial marker. In such a situation, device 82 may be configured to audibly output "PAPER MISFEED" and contact either an on-site or remote customer service representative via audio or visual cues (such as a flashing light) to fix the problem. In another embodiment, device 82 may be configured to tell the user to "LOOK AT THE SCREEN" when information is required from the user or important information is displayed for the user. In yet another embodiment, device 82 may be configured to audibly output "YOUR PRODUCT IS READY" when the sublimation process is complete and the product is cooled to a safe handling temperature. In some embodiments, the audio output capabilities of vending apparatus 800 may extend to the input components. Device 82 may be configured such that key presses on a virtual keyboard or touchscreen associated with the device elicit confirmatory clicking noises. Additionally, the input components of device 82 may be configured to provide tactile or visual feedback to the user to indicate that an input member, such as a key of a keyboard, has been successfully pressed.

In some embodiments, user interface device 82 may include a camera 84, which can capture an image at the point of sale to utilize in the printing process and transmit the captured image to printer 2. Camera 84, in conjunction with networking capabilities of device 82, may enable a user in another physical location to perform remote diagnostics, maintenance, and calibration of vending apparatus 800, as well as perform customer service functions to assist a user of the apparatus. The memory of device 82 may contain a plurality of stock images for the consumer to choose from to supplement a user-supplied image or an image captured by camera 84. In some embodiments, device 82 may be configured to receive input of personal information from the consumer to be sublimated onto a product. Such personal information may include, but is not limited to, a name associated with the consumer, contact information, initials/monogramming, etc. Device 82 may be configured to generate an image including the received personal information. In some embodiments, device 82 may permit the consumer to select from a plurality of possible stock images to incorporate the personal information. In still other embodiments, device 82 may be configured to, at the selection of the consumer, synthesize the personal information into a selected stock image from the device memory, and provide the single synthesized image to printer 2 for printing onto transfer media. In other embodiments, device 82 may provide the consumer with the capability to select a product from magazine 88 for sublimation that is pre-printed with a stock image stored in the memory of device 82. Device 82 may be configured to store the received personal information as well as any personalized, synthesized, or stock images created or selected by the consumer. Further, device 82 may be configured to prompt the consumer for additional products that they may desire to have sublimated with the same image. Device 82 may be configured to transmit the stored consumer image to a remote network server, and may communicate an indication to the consumer information about additional sublimated or customized products that might be available for the consumer that can be printed and shipped from a remote location. The indication may be communicated to the consumer through various known means of communication, such as by telephone, email, social media, or on an internet webpage associated with one or more of the consumer, the retail outlet hosting vending apparatus 800, or the maker of vending apparatus 800. In some embodiments, device 82 may provide further options to the user, including customizing and purchasing accessories for the sublimated product, or configuring a delivery vehicle for the product. Device 82 may also be configured to prompt the user to select a companion accessory for the sublimated product. In some embodiments, the accessory also may be capable of sublimation by the apparatus. In some embodiments, the user may be prompted to insert a desired accessory into the machine, or the accessory may be contained within the apparatus. Device 82 may be configured to coordinate and collect payment for the accessory. In some embodiments, apparatus 800 may be configured to utilize the used transfer media as a delivery vehicle for the sublimated product. In such embodiments, the transfer media may be preprinted on one or more sides with text or images associated with the retail outlet hosting vending apparatus 800, or the maker of vending apparatus 800.

Device 82 and camera 84 may be configured to allow interaction with vending apparatus 800 by remote operators. Device 82 may be configured to include a "hot button" that when pressed, sends a notification to the remote operator asking for live video or audio contact with the operator of the apparatus. In some embodiments, a remote technician may be capable of being notified by device 82, and able to view system components live through camera 84. Device 82 may be further configured to enable control by the remote technician, who could then perform service on vending apparatus 800 such as clearing jammed transfer media, removing a stuck product from a magazine, retrieving a dropped accessory, etc. In other embodiments, device 82 and camera 84 may enable real-time customer service interactions with a user. When either a customer or an operator such as a store clerk have questions about the process or require assistance, a remote customer service representative may be contacted via device 82's hot button and can interact live with the customer. In some embodiments, device 82 may be configured to facilitate live video chat on an included display screen with the representative. In other embodiments, device 82 may be configured to facilitate live audio interaction with the representative, similar to a telephone call. In yet other embodiments, pressing the hot button may activate a text-based live chat, or send an email to the customer service representative. In some embodiments, the remote customer service may be a value-added service, as the service representative can assist a consumer in purchasing and customizing additional products and/or accessories.

Device 82 may be further configured to coordinate and collect payment for the sublimation task. The memory of device 82 may contain information relating to pricing for various types of the plurality of products. The pricing may vary by product, and may vary based on other predetermined criteria, such as the quantity of objects desired, image processing tasks completed, images acquired via camera 84, etc. Device 82 may display the pricing information on an output screen to the user. Device 82 may include, or be connected to, payment acceptance components that can accept cash, credit cards, or other payment methods from the consumer, such as a coupon, or a payment application on a mobile device. Device 82 may include a printer that can provide the consumer with a receipt of the payment transaction. In some embodiments, the receipt may also contain other information, such as an Internet URL for a website associated with either the retail outlet hosting vending apparatus 800, or the maker of vending apparatus 800 for purposes of additional possible products. Device 82 may be integrated into housing 80, or it may be disposed as a distinct device proximal to housing 80 but not integrated within it. It should be understood that a device similar to device 82, with any of the above configurations, may be provided as part of any apparatus contemplated by this invention, whether in a vending or retail context or not.

Housing 80 may be configured to include at least one surface portion 86 comprised of a transparent material. The material may comprise, as non-limiting examples, acrylic, glass, fiberglass, plastic, or a hybrid material. Transparent surface portion 86 may be oriented in a manner that makes the components of the dye sublimation printer apparatus, such as apparatus 100, visible to a consumer or other operator while safely shielding the user from heat, pinch points, stored energy sources, and other such potential hazards associated with the operation of heavy machinery. Transparent surface portion 86 may provide entertainment and education to the user while the sublimation task is underway, and may also allow an operator to take note of components of the apparatus requiring maintenance or repair. In some embodiments, transparent surface portion 86 may facilitate remote diagnostics, maintenance, and user assistance via the configured features of user interface device 82.

Figure 11:
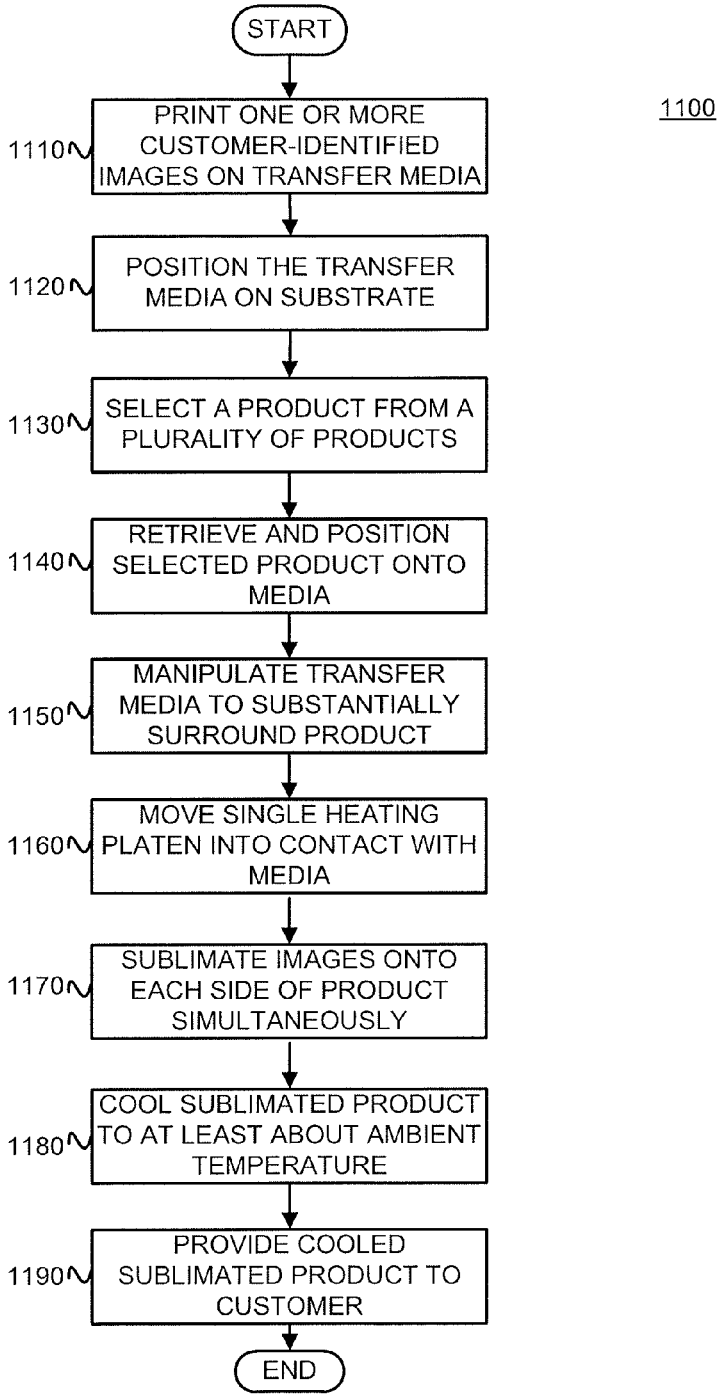
FIG. 11 is a flowchart of an exemplary dye sublimation transfer printing process, consistent with disclosed embodiments.

Vending apparatus 800 may be configured to perform a single platen double-sided sublimation process, such as that shown in the example of FIG. 11. In one embodiment, vending apparatus 800, via printer 2, may print one or more customer-identified images on a transfer media (Step 1110). In some embodiments, the image(s) may be a user provided image received through user interface device 82. In other embodiments, the image(s) may be stock images preloaded into the memory of user interface device 82. In still other embodiments, the image(s) may constitute text input received by device 82. In yet other embodiments, the image(s) may be captured by camera 84. The image(s) may also represent a combination or composite of the above described options.

Vending apparatus 800 may position the transfer media onto a substrate, such as substrate 10 (Step 1120). As discussed above, in some embodiments, the transfer media may comprise sheets of transfer media configured to include a bisecting feature, and are deposited onto tray 4 after being printed by printer 2. In some embodiments, transport mechanism 6 may move the printed sheet of transfer media from tray 4 to substrate 10. As discussed, in alternative embodiments, vending apparatus 800 may be configured to move the transfer media to substrate 10 in a variety of ways. Once placed in proximity to substrate 10, vending apparatus 800 may position and align the transfer media on the substrate using one or more of the components described above, such as mechanical guides, mechanical switches, optical switches, machine vision systems, or a combination of one or more such components.

In one embodiment, vending apparatus 800 may be configured to select a product from a storage compartment, such as storage compartment 88 (Step 1130). Storage compartment 88 may be configured in some embodiments to contain a plurality of different products. User interface device 82 may be configured to prompt a consumer to select one of the plurality of products stored in the storage compartment.

Vending apparatus 800 may retrieve and position the selected product onto the transfer media (Step 1140). In some embodiments, the selected product is placed automatically by vending system 800 onto staging position 12, and then transport mechanism 6 (via head 8) transports the product from staging position 12 to substrate 10. Alignment of the selected product on the transfer media may also utilize one or more of the mechanical guides, mechanical switches, optical switches, and machine vision systems described above. The selected product may be aligned onto one of the printed images on the transfer media. In some embodiments, transport mechanism 6, may further be configured to manipulate the transfer media to substantially surround the product (Step 1150), wherein at least one printed image is positioned on each side of the product. Transport mechanism 6 may manipulate the media using head 8. Head 8 may be configured to include mechanical implements to manipulate the media, such as pegs, hooks, etc. Apparatus 800 may be configured to manipulate the transfer media by folding the media along the bisecting feature. Upon folding the media, one or more images may be positioned proximal to each side of the product to be sublimated.

Process 1100 continues with vending apparatus 800 moving a single heating platen, such as heating platen 14, into contact with the transfer media (Step 1160) and sublimating the one or more printed images onto opposing sides of the product substantially simultaneously in a single thermal cycle (Step 1170). In some embodiments, the single thermal cycle may further include a predetermined pressure. In some embodiments, parameters for the single thermal cycle that enable simultaneous printing on multiple sides of a product may be determined automatically by apparatus 800. The parameters may be based on one or more of the material comprising the product, the dimensions of the product, characteristics of the printed images, or other predetermined criteria.

After sublimating the image onto the selected product, in some embodiments vending apparatus 800 may cool the printed product to at least about an ambient temperature (Step 1180). Vending apparatus 800 may cool the product using an optionally-equipped cooling system 18 as described above. Vending apparatus 800 may employ an active cooling system, using fans, sprayers, water baths, etc., or may employ a passive system, such as heat sinks and thermally conductive panels. As discussed above, vending apparatus 800 may be configured to limit consumer access to the sublimated product via delivery opening 20 until the product has sufficiently cooled. Once the sublimated product has cooled to about an ambient temperature, vending apparatus 800 may be configured to provide the product to the customer via delivery opening 20 (Step 1190). In some embodiments, user interface device 82 may facilitate and receive payment for the product, and may prevent access to the product until payment is received.

Figure 9B:
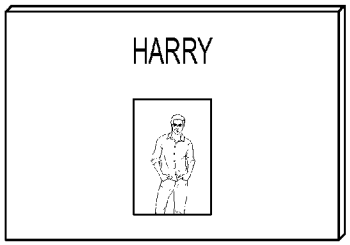
FIGS. 9A-9F are diagrammatic illustrations of customized images produced by an integrated dye sublimation transfer printing vending machine consistent with disclosed embodiments.
Figure 9C:
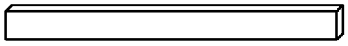
Figure 9D:
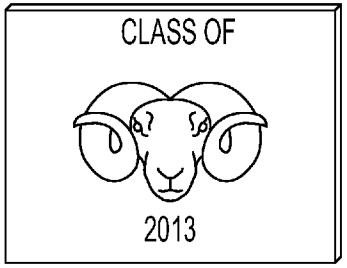
Figure 9A:
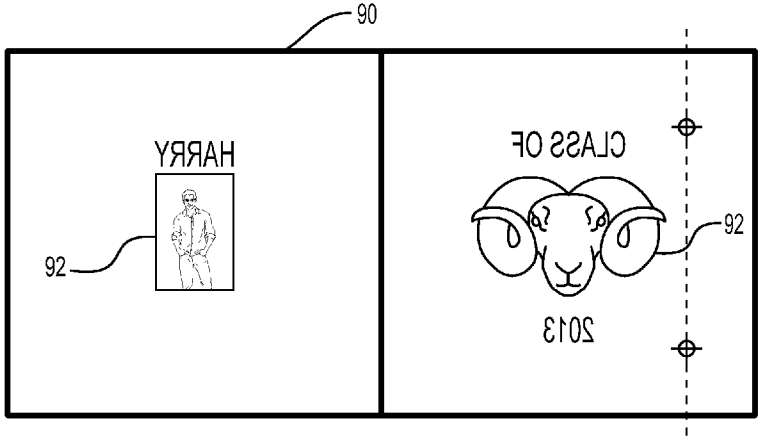

FIGS. 9A-9F illustrate exemplary images that may be associated with the apparatuses described above in association with FIGS. 1-8. In FIG. 9A, a single sheet 90 of transfer media is shown, with printed images 92 printed (by a printer such as printer 2 or printer 30) onto either side of the bisecting feature. Image 92 is an example of an image that may be determined by a consumer for printing. In some embodiments, the image(s) may be a user-provided image received through user interface device 82. In other embodiments, the image(s) may be stock images preloaded into the memory of user interface device 82. In still other embodiments, the image(s) may constitute text input received by device 82. In yet other embodiments, the image(s) may be captured by camera 84. The image(s) may also represent a combination or composite of the above described options. In some embodiments, the consumer may provide the image by portable media as discussed above. As discussed above, a printed sheet 90 such as that described in FIG. 9A would be aligned onto a substrate, such as substrate 10 or substrate 36, and engaged by one or more heating platens, such as heating platen 14 or heating platen 42, for sublimation onto one or more products. In some embodiments, as shown in FIG. 9A, images 92 may be mirrored by the apparatus from their original orientation to facilitate simultaneous double-sided printing. Printers 2 and 30 may be configured to automatically process and invert one of the images 92 such that they may be printed in the mirrored fashion. In some embodiments, further processing may also be performed by the printer, such as offsetting the images 92 from one another to fit dimensions of a product, altering the size of an image 92, etc. FIGS. 9B, 9C, and 9D illustrate top, side, and bottom views, respectively, of a finished product that has been sublimated using the transfer media and images featured in FIG. 9A.

In some embodiments, the printed images 92 may be mirror images of one another and are situated substantially symmetrically with respect to one another on the transfer media sheet 90. In this configuration, the same image would thus be sublimated onto the opposing sides of the product. The sublimated images may be aligned in a predetermined manner on each side of the product and aligned in a predetermined manner with respect to one another. In some embodiments, the images may be centered on the surface of the product. In some embodiments, the images may be offset from one another with respect to the bisecting feature in sheet 90, and may not be symmetrical. This may be desirable in certain product configurations, or to accommodate accessories, additional images, etc.

Figure 9F:
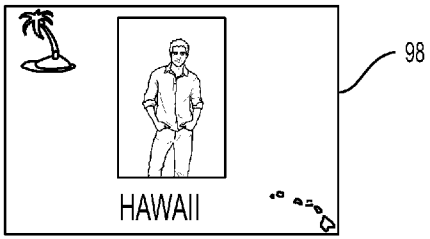
Figure 9E:
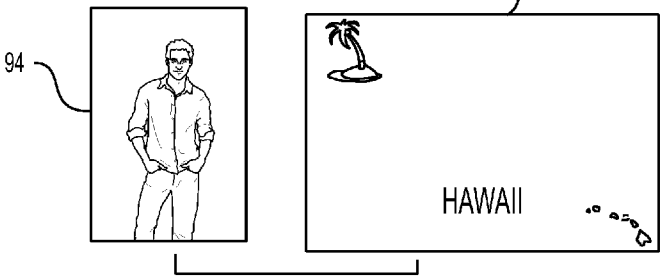

FIGS. 9E and 9F illustrate examples of a user-provided image 94, a stock image 96, and a synthesized image 98 as described above in relation to vending apparatus 800. Image 94, like image 92, may represent either a consumer-supplied image or an image captured by camera 84. Image 96 may be an example of a stock image, contained in the memory of a user interface device such as device 82 of apparatus 800. In the example of image 96, elements relating to a geographical destination, in this case, Hawaii, constitute the image. As discussed above, a consumer may opt, via device 82, to synthesize a consumer-provided image such as image 94 with a stock image, such as image 96, to create a synthesized image 98. The user interface device could then provide synthesized image 98 to a dye sublimation printer, such as printer 2 or printer 30, to print the image in preparation for sublimation. Of course, a consumer could alternatively select to print only image 94 onto a product, or only image 96. In still other embodiments, a consumer could opt to print a consumer-supplied image such as image 94 onto one surface of a product, and print a stock image like image 96 onto another surface. Other alternatives are possible, such as consumer-supplied image 94 and synthesized image 98 on opposing sides of a product, etc.

Figure 12:
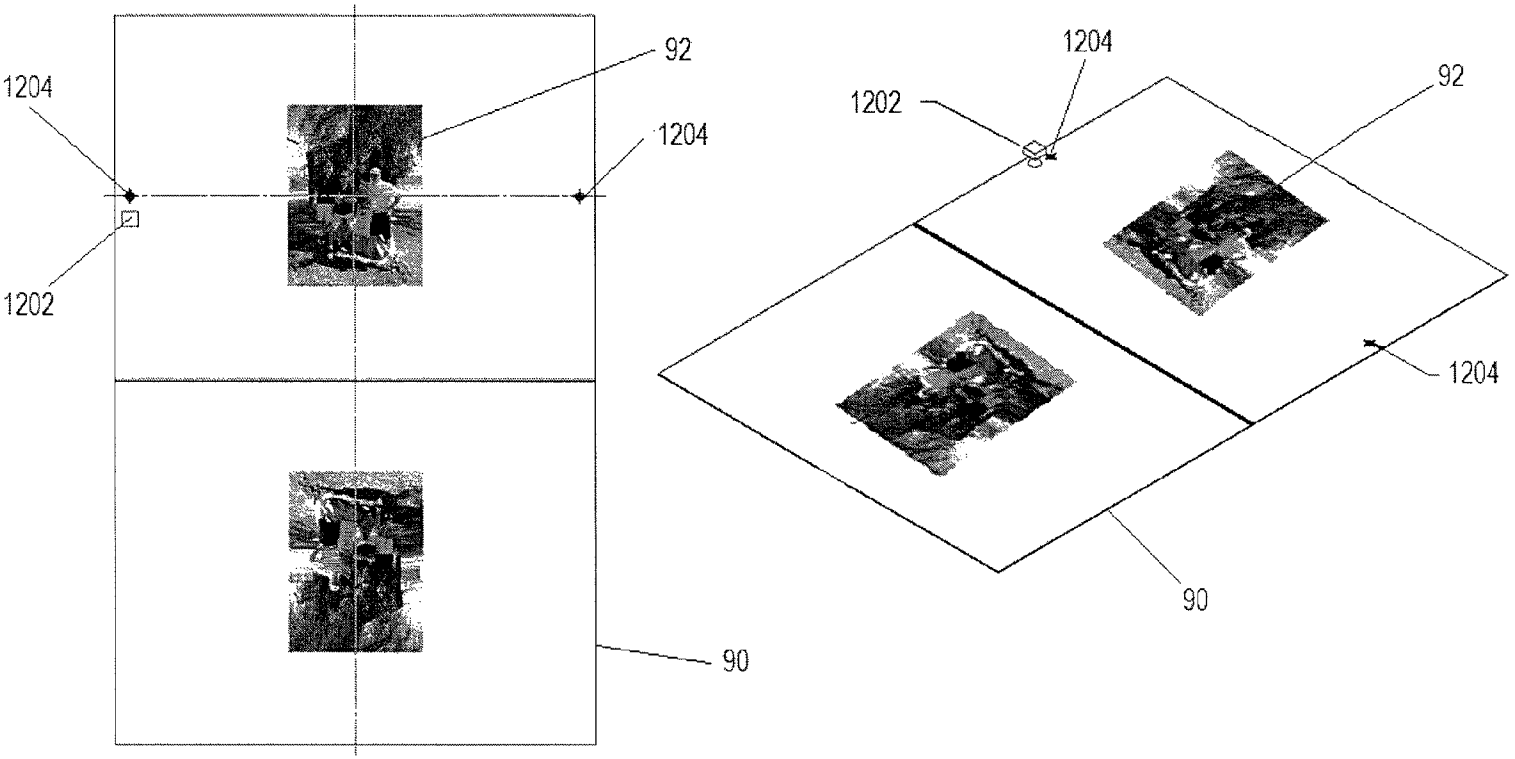
FIG. 12 is a diagrammatic illustration of optional registration and alignment features consistent with disclosed embodiments.

In some embodiments, the transfer media may contain one or more printed indicia and/or fiducial markers readable by the machine vision tracking system described previously to confirm location and orientation of the transfer media. An example of such an embodiment is illustrated in FIG. 12. Proper alignment of the transfer media in a sublimation printing apparatus such as apparatuses 100, 300, or 800 described above is particularly important when the apparatus is configured to print on opposing sides of a product substantially simultaneously. Even a slight misplacement of the transfer media, and thus the printed images, may trigger a defective sublimated product.

FIG. 12 illustrates a top view and a perspective view of a sheet of transfer media with images printed on its surface, such as sheet 90 and images 92 described above in association with FIG. 9. In the example illustrated in FIG. 12, the sublimation apparatus (which may be, for example, any one of apparatuses 100, 300, or 800) may be equipped with a machine vision tracking system 1202. System 1202 may be substantially as described above, and may include one or more cameras, as well as one or more control units capable of executing software commands. System 1202 may be mounted in a fixed position on a transport mechanism, such as transport mechanism 6, or it may be configured to freely move along the mechanism. In the example of FIG. 12, sheet 90 has been printed with a set of fiducial markers 1204.

Tracking the location of the printed sheets of transfer media using the fiducial markers at all times within the apparatus may be important to ensure quality of the image transfer and to prevent hazards, such as overheating or melting of the transfer media. Even slight overheating of transfer media may create extremely unpleasant odors that could irritate the user and other surrounding customers. Therefore, the machine vision tracking system 1202 may be configured to confirm the location of a given sheet of transfer media such as sheet 90 in the apparatus using visual confirmation or scanning means at set time periods, or when contact or non-contact sensors detect that sheet 90 has progressed to a new part of the apparatus. The machine vision tracking system 1202 may determine that sheet 90 is susceptible to overheating and preemptively act to de-energize the heating platen and request service. This process may occur, for example, when the machine vision tracking system 1202 determines that the media and heating platen have been in contact for a time period exceeding a predetermined threshold value. The predetermined threshold value may be based on the temperature of the platen or properties of the product being sublimated.

The fiducial markers 1204 may also serve as indicators of the condition of the apparatus; if the apparatus senses via the markers that the transfer media is being consistently misaligned, hung up, or otherwise not moved smoothly through the system, it may indicate that the apparatus requires maintenance. Markers 1204 may constitute machine-readable barcodes, printed patterns, QR codes, etc. In some embodiments, markers 1204 may be directly read by machine vision tracking system 1202. In other embodiments, images of markers 1204 may be captured by a camera, which may or may not be part of system 1202, and the images may be analyzed and confirmed via software. Markers 1204 may be pre-printed on sheet 90, or they may be printed by printer 2 at the time images 92 are printed onto sheet 90. In some embodiments, the markers 1204 may constitute crosshairs, and one or more markers may be placed around the periphery of the printed image to assist with alignment tasks governed by transport mechanism 6 and substrate 10 as described.

In some embodiments, fiducial markers 1204 may be utilized by apparatus 100 or 300 to perform an automatic self-calibration process. A user interface device associated with the apparatus may configure printer 2 to print calibration images onto transfer media. The calibration images may comprise a pattern readable by components of the apparatus, such as machine vision tracking system 1202, as well as a set of fiducial markers 1204. Once printed, the transfer media bearing the calibration images may be transported from printer 2 to substrate 10 by transfer mechanism 6 and end effector 8, as described. Machine vision tracking system 1202 may be configured to track the alignment of the calibration images using fiducial markers 1204 as described above. System 1202 may be further configured to compare the location of markers 1204 (e.g., using coordinates) when the transfer media is aligned on substrate 10 to a predetermined set of coordinates associated with an "ideal" alignment, such as a "home" position, or a default configuration. System 1202 may be configured to determine offsets in each dimension using the calibration images on the transfer media. The offset information may be stored locally in a memory device associated with the user interface device, or the user interface device may be configured to transmit the information to a remote server. Apparatuses 100 or 300 may be configured to automatically adjust the calibration of relevant components to correct the offsets, such as printer 2, transport mechanism 6, end effector 8, substrate 10, or machine vision tracking system 1202.

Figure 13:
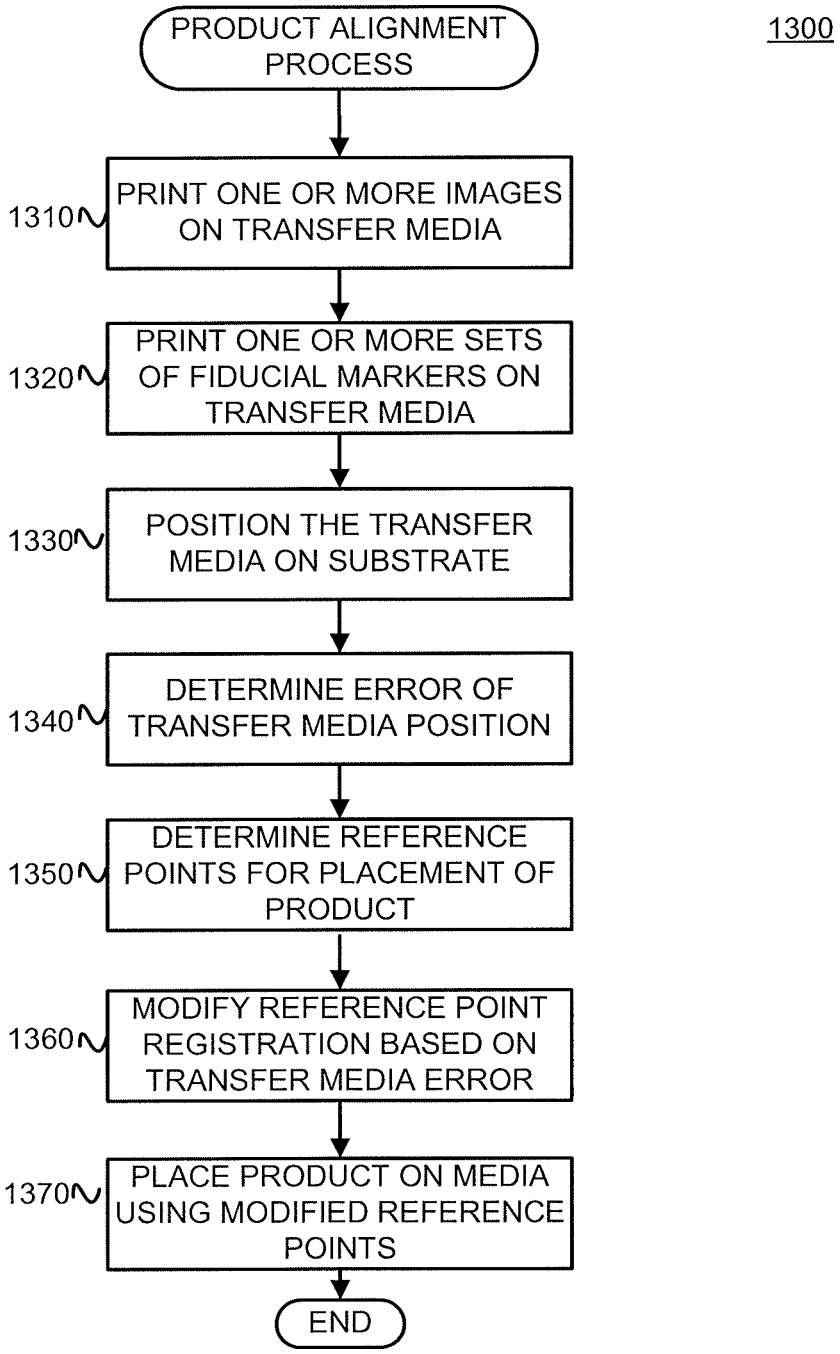
FIG. 13 is a flowchart of an exemplary product alignment process, consistent with disclosed embodiments.

A sublimation printing apparatus (such as apparatus 100, 300, or 800 described above) may be configured to perform a product alignment process 1300 to ensure the quality of a simultaneous double-sided sublimation, such as that shown in the example of FIG. 13. In one embodiment, the apparatus, via a printer such as printer 2, may print one or more images on a transfer media (Step 1310). As described above, the printed images may be received by printer 2 as digital image files by a variety of different means.

As discussed above in the example of FIG. 12, in some embodiments, printer 2 may print a set of fiducial markers, such as markers 1204, onto the transfer media (Step 1320). In alternative embodiments, markers 1204 may be pre-printed onto the transfer media before introduction into printer 2. The location of markers 1204 may be variable based on the size and position of the printed images, as well as the size and shape of the product to be sublimated. Printer 2 may be configured with software to determine proper arrangement of markers 1204. In some embodiments, a user interface device such as device 82 described above may be included in the apparatus, and may determine the proper arrangement of markers 1204. Device 82 may subsequently configure printer 2 to print markers 1204 on the transfer media.

The apparatus, via a transport mechanism such as transport mechanism 6, may position the transfer media on a substrate, such as substrate 10 (Step 1330). This process may occur substantially as described above, and transport mechanism 6 (including end effector 8) and/or substrate 10 may include various sensors or systems to ensure proper feeding and translation of the transfer media onto substrate 10.

In some embodiments, placement of the transfer media may not exactly match an "ideal" or perfect placement. Due to imperfections in the transfer media, substrate 10, disruption by ambient air flow, etc., the transfer media may be mislaid to a certain extent. The apparatus may determine an error measurement for the transfer media alignment based on variations in the coordinate positions of markers 1204 as compared to stored coordinate positions of an "ideal alignment (Step 1340). Errors even as small as a few thousandths of an inch could result in a lower quality sublimation transfer when the transfer is double-sided, because the error is essentially propagated twice within the system.

In some embodiments, transport mechanism 6 and end effector 8 may be configured to simply move the transfer media such that markers 1204 do align with the coordinates of "ideal" placement. However, in other embodiments it may be preferable to simply adjust the placement of the product to be sublimated in order to account for the error in the placement of the transfer media. In some embodiments, transport mechanism 6 and/or device 82 may determine virtual reference points for placement of each product to be sublimated relative to the "bottom image;" that is, the image that will eventually be sublimated onto the bottom surface of the product (Step 1350). These virtual reference points may be coordinate positions on each of the printed image and/or the product, and may be determined by transport mechanism 6 and/or device 82 using software. In some embodiments, where the sublimated image is to be centered on the product, the coordinates may be the centroid of the printed image and the bottom surface of the product. In other embodiments, the coordinates of the virtual reference points may be located elsewhere on the image and/or the product.

The sublimation apparatus may account for any error determined in the placement of the transfer media on substrate 10 in Step 1340, using fiducial markers 1204, and modify reference points for placement of the product accordingly (Step 1360). For example, if the apparatus determined that the transfer media was mislaid by 0.01 inches in the X direction and 0.006 inches in the Y direction, software components associated with the apparatus may adjust the reference point of the product by the same amount to counter the error in the placement of the transfer media. Transport mechanism 6 may then be configured to place the product on the transfer media using the modified reference points (Step 1370). In some embodiments, transfer mechanism 6 and/or machine vision tracking system 1202 may capture an image of the product once placed on the transfer media, and associated software components may visually confirm that the product is properly placed and aligned for a double-sided sublimation process.

Figure 15:
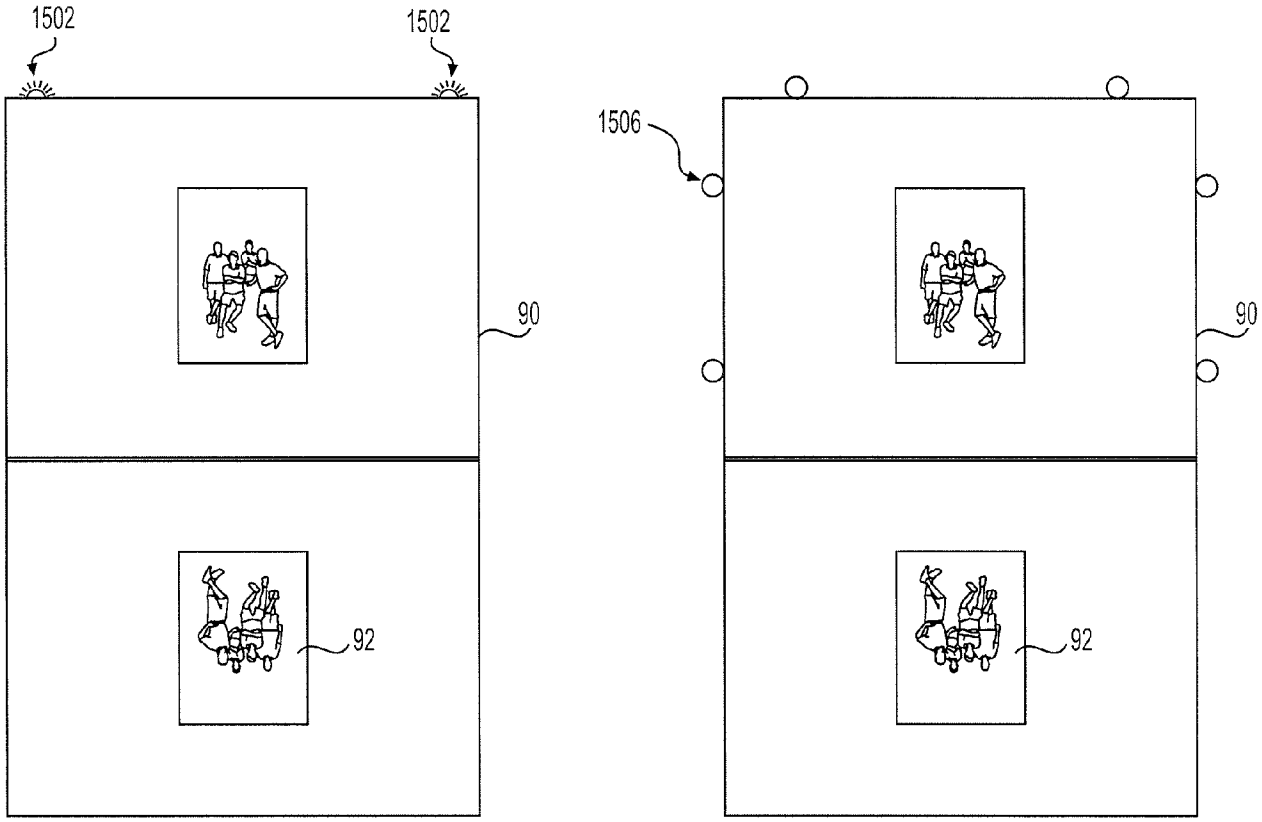
FIG. 15 is a diagrammatic illustration of optional registration and alignment features consistent with disclosed embodiments.

In some embodiments, as discussed above, alignment of the transfer media on the substrate of a disclosed apparatus (such as substrate 10 or substrate 36) may be additionally facilitated by optional mechanical sensors and or non-contact sensors. Examples of such implements are illustrated in FIG. 15. As discussed above, proper alignment of the transfer media in a sublimation printing system such as systems 100, 300, or 800 described above is particularly important when the system is configured to print on opposing sides of a product substantially simultaneously.

Transport mechanism 6 and substrate 10 may include one or more non-contact sensors 1502 to aid in automatic transfer media and/or product alignment, orientation, and registration. Non-contact sensors within the scope of the invention include, but are not limited to, optical sensors, proximity sensors, or digital cameras, which may be mounted on any or all of transport mechanism 6, end effector 8, and substrate 10. For example, sensors 1502 may comprise light sources configured to provide through-beams of visible, infrared, or laser light that may indicate to an operator if the transfer media is properly aligned and registered on substrate 10. The indication may occur visually on substrate 10 or a nearby structure itself (for example, red and green LED lights, with the green light illuminating when the transfer media is properly aligned or past a certain location within the apparatus), or may be transmitted to a user interface device and presented in a graphical user interface.

Non-contact sensors 1502 may be associated with one or more control units that control the motion of transport mechanism 6 and/or end effector 8, and may form part of an integrated, automated alignment system. For example, in some embodiments transport mechanism 6 may be configured to transport and align a sheet of printed transfer media from tray 4 to substrate 10. When configured to include non-contact sensors 1502, apparatus 100 may be configured to control the extent of movement of transport mechanism 6. As described above, sensors 1502 may be configured to sense that the transfer media has passed over them, such as by breaking a through-beam, by sensing a change in optical clarity, or by a visual confirmation if sensors 1502 are configured to include a digital camera. When sensors 1502 are triggered, they may signal to the control unit controlling transport mechanism 6 and/or end effector 8 to immediately cease further forward motion of the transfer media onto the substrate. Sensors 1502 may be further configured to detect misalignment of the transfer media. For example, if the transfer media is placed on substrate 10 at a slight angle, sensors 1502 may be able to detect the error in the media placement and either signal to the control unit controlling transport mechanism 6 to take corrective measures, or signal to other software components to account for the misplacement during further operation of the system.

In other embodiments, substrate 10 may be disposed relative to tray 4 such that a series of mechanical guides assist in the placement of the transfer media. For example, tray 4 may be configured to form a funnel shape, such that the transfer media can only approach substrate 10 in a predetermined manner. Substrate 10 may be fitted with guide rails or other such stationary mechanical implements to position and align the transfer media and/or products, such as mechanical implements 1506. Such mechanical implements may be disposed under the immediate surface of substrate 10, and may be situated in holes or divots in substrate 10. In some embodiments, mechanical implements 1506 may be retractable, and are only visible and engaged while aligning and positioning the transfer media.

In some embodiments, implements 1506 may be configured as mechanical switches that provide guidance for orientation and alignment of the transfer media. In these embodiments, implements 1506 may serve as stops for the transfer media, such that when an edge of the media hits the switch, system 100 automatically stops moving the media in that direction. In other embodiments, implements 1506 may be configured to serve as gates, and may be retractable. The transfer media may be fed or transported over top of implements 1506, then positioned in the X-Y dimension once beyond them.

As configured, the methods and apparatuses contemplated by the invention allow substantially simultaneous sublimation of multiple sides of a product. The ability to sublimate multiple sides of a product at the same time opens up new revenue opportunities for sublimated products by reducing the time and operator skill needed to align and transfer printed images to products. The quality of the sublimated products is also improved by this process, as a single thermal cycle and single alignment process reduces misprints and errors in the transfer. Another advantageous element of the invention is the use of a single heating platen rather than multiple platens. Use of one platen rather than two or more reduces the footprint of the system and makes it possible to deploy sublimation printing systems in a wider variety of locations and contexts. A single platen also reduces the cost of the system, reduces maintenance downtime, and reduces energy costs. Simultaneous double-sided sublimation products created with a single heating platen system may open myriad new markets and opportunities, particularly in the retail environment.

Other embodiments of the invention will be apparent to those skilled in the art from consideration of the specification and practice of the invention disclosed herein. It is intended that the specification and examples be considered as examples only, with a true scope and spirit of the invention being indicated by the following claims.

What is claimed is:

1. An apparatus for sublimating an image on a product, comprising:

a dye sublimation transfer printer configured to receive one or more digital image files representing one or more images, the dye sublimation transfer printer configured to print the received one or more images on a single sheet of transfer media;

a substrate configured to receive the sheet of transfer media from the printer;

a single heating platen configured to engage the sheet of transfer media by contacting the transfer media, and a control unit for configuring a single thermal cycle for the single heating platen such that the one or more images will be sublimated substantially simultaneously onto each side of the product to be sublimated in a single thermal cycle; and a transport mechanism configured to position the product onto the sheet of transfer media and manipulate the sheet of transfer media to substantially surround the product, wherein at least one printed image is positioned onto each side of the product to be sublimated.

2. The apparatus of claim 1, wherein the control unit is configured to set at least one of a programmed temperature, duration, linear distance traveled by the single heating platen, and pressure for the single thermal cycle.

3. The apparatus of claim 2, wherein the control unit sets a programmed duration of the single thermal cycle by determining a duration sufficient to permit development of a predetermined heat gradient within the product sufficient to achieve a sublimation temperature at the surface of each side of the product to be sublimated.

4. The apparatus of claim 3, wherein the heat gradient includes a first temperature proximate a first side of the product and a second temperature proximate a second side of the product, the first temperature being less than a maximum processing temperature of the sheet of transfer media, and the second temperature being at least a minimum effective sublimation temperature.

* * * * *